US010756493B2

(12) United States Patent
Mori

(10) Patent No.: US 10,756,493 B2
(45) Date of Patent: Aug. 25, 2020

(54) CONNECTOR AND ELECTRIC WIRE WITH CONNECTOR

(71) Applicant: Yazaki Corporation, Tokyo (JP)

(72) Inventor: Yuki Mori, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/361,957

(22) Filed: Mar. 22, 2019

(65) Prior Publication Data

US 2019/0296499 A1 Sep. 26, 2019

(30) Foreign Application Priority Data

Mar. 26, 2018 (JP) ..... 2018-057623

(51) Int. Cl.
*H01R 13/6592* (2011.01)
*H01R 4/18* (2006.01)
(Continued)

(52) U.S. Cl.
CPC ..... *H01R 13/6592* (2013.01); *H01R 4/183* (2013.01); *H01R 9/03* (2013.01); *H01R 9/0524* (2013.01); *H01R 13/512* (2013.01); *H01R 13/6581* (2013.01); *H01R 43/18* (2013.01); *H01R 43/28* (2013.01)

(58) Field of Classification Search
CPC ..... H01R 13/5205; H01R 13/516; H01R 13/6592; H01R 13/512; H01R 13/6581; H01R 4/183; H01R 9/03; H01R 9/0524; H01R 43/18; H01R 43/28
See application file for complete search history.

(56) References Cited

U.S. PATENT DOCUMENTS 5,711,686 A * 1/1998 O'Sullivan ..... H01R 9/038 439/607.41
7,727,021 B2 * 6/2010 Haruna ..... H01R 9/037 439/607.41
(Continued)

FOREIGN PATENT DOCUMENTS

EP 3 076 485 A2 10/2016
JP 2002-8744 A 1/2002
(Continued)

*Primary Examiner* — Abdullah A Riyami
*Assistant Examiner* — Nader J Alhawamdeh
(74) *Attorney, Agent, or Firm* — Sughrue Mion, PLLC

(57) ABSTRACT

A connector includes a shield shell that has a sub shield body covering the electric connection portions and the terminals of the electric wires externally, and first and second holding members and that hold exposed braids at the terminals of the electric wires. The sub shield body has a second accommodation chamber that covers the exposed braids at the terminals of the electric wires and the first and the second holding members externally. The first and the second holding members are members holding, along axial lines of the terminals of the electric wires, annular development portions of the braids that are formed by annularly developing the exposed braids to the outer side in the radial direction, have annular holding portions interposing the annular development portions therebetween, and are pressed against and fixed to the shield shell along the holding direction of the annular development portions.

13 Claims, 16 Drawing Sheets

(51) Int. Cl.

| | |
|---|---|
| ***H01R 9/03*** | (2006.01) |
| ***H01R 13/512*** | (2006.01) |
| ***H01R 13/6581*** | (2011.01) |
| ***H01R 43/18*** | (2006.01) |
| ***H01R 9/05*** | (2006.01) |
| *H01R 43/28* | (2006.01) |

(56) References Cited

U.S. PATENT DOCUMENTS

| | | | | |
|---|---|---|---|---|
| 8,056,867 | B2 * | 11/2011 | Tan Chin Yaw | H01R 13/631 248/49 |
| 10,027,054 | B2 * | 7/2018 | Takeshita | H01R 13/6581 |
| 10,418,743 | B2 * | 9/2019 | Mori | H01R 13/4364 |
| 2007/0087621 | A1 | 4/2007 | Fukushima et al. | |
| 2009/0258521 | A1 * | 10/2009 | Ooki | H01R 13/5216 439/275 |
| 2015/0288101 | A1 * | 10/2015 | Matsunaga | H01R 13/4538 439/378 |
| 2016/0036155 | A1 * | 2/2016 | Kataoka | H01R 13/521 439/736 |
| 2016/0111809 | A1 * | 4/2016 | Kataoka | H01R 13/5205 439/587 |
| 2016/0134049 | A1 * | 5/2016 | Kataoka | H01R 13/5205 439/587 |
| 2016/0205815 | A1 | 7/2016 | Mori et al. | |
| 2019/0190192 | A1 * | 6/2019 | Mori | H01R 13/621 |
| 2019/0190211 | A1 * | 6/2019 | Yamanashi | H01R 13/502 |
| 2019/0363479 | A1 * | 11/2019 | Yamanashi | H01R 13/5825 |

FOREIGN PATENT DOCUMENTS

| | | | |
|---|---|---|---|
| JP | 2007-115428 | A | 5/2007 |
| JP | 2015-84276 | A | 4/2015 |

* cited by examiner

CONNECTOR AND ELECTRIC WIRE WITH CONNECTOR

CROSS-REFERENCE TO RELATED APPLICATION(S)

The present application claims priority to and incorporates by reference the entire contents of Japanese Patent Application No. 2018-057623 filed in Japan on Mar. 26, 2018.

BACKGROUND OF THE INVENTION

1. Field of the Invention

The present invention relates to a connector and an electric wire with a connector.

2. Description of the Related Art

Conventionally, a connector includes a terminal fitting connected to a terminal of an electric wire and an insulating accommodation body accommodating therein the terminal fitting, and electrically connects the terminal fitting to a counterpart terminal fitting of a counterpart connector by fitting the accommodation body into a housing of the counterpart connector. As for the connector and the electric wire with the connector, in order to reduce penetration of noise into the terminal fitting and the electric wire, the electric wire is configured as a shield electric wire including a cylindrical mesh braid and a shield shell covers the terminal fitting and the electric wire along with the whole accommodation body. At the terminal of the electric wire, the braid that is exposed by removing coating is folded back in the opposite direction and a conductive cylindrical shield member is crimped to the braid. The cylindrical shield member is electrically connected to the shield shell and is grounded through the shield shell. For example, Japanese Patent Application Laid-open No. 2007-115428 discloses a connector and an electric wire with the connector of this type.

In the conventional connector and the conventional electric wire with the connector, the cylindrical shield member is crimped to the terminal of the electric wire along with the whole braid and force with the crimping is transmitted to an internal core wire as well. Thus, the conventional technique ensures crimping force of the cylindrical shield member to the braid and improves durability and shield performance of the electric wire while reducing the transmission of the force to the core wire by interposing another cylindrical member between the braid at the outer side and the coating at the inner side and receiving the force with the crimping of the cylindrical shield member on the cylindrical member. Japanese Patent Application Laid-open Nos. 2015-84276 and 2002-8744 disclose a technique of interposing an annular development portion of a shield member (braid) between two plates. In the technique of Japanese Patent Application Laid-open No. 2015-84276, the two plates and the annular development portion are electrically connected to each other by caulking crimping of a plurality of caulking pieces on one plate to the other plate. In the technique of Japanese Patent Application Laid-open No. 2002-8744, the two plates and the annular development portion are electrically connected to each other by providing one plate on a mounting member that is externally fitted to a cylindrical portion of the shield member and externally fitting the mounting member to the cylindrical portion of the shield member. In these techniques of Japanese Patent Application Laid-open Nos. 2015-84276 and 2002-8744, it is difficult to make contact pressures by the two plates to the annular development portion uniform and there is room for improvement in the shield performance.

SUMMARY OF THE INVENTION

An object of the present invention is to provide a connector and an electric wire with a connector that can improve endurance and shield performance of an electric wire.

In order to solve the above mentioned problem and achieve the object, a connector according to one aspect of the present invention includes a terminal fitting that has an electric connection portion configured to be electrically connected to a counterpart terminal of a counterpart connector and an electric wire connection portion configured to be electrically connected to a terminal of an electric wire; an insulating accommodation body configured to accommodate the electric connection portion in an internal accommodation space and allow the electric wire connection portion to project outward together with the terminal of the electric wire; a conductive shield member that has a main shield body covering the accommodation body externally and a sub shield body covering the electric wire connection portion and the terminal of the electric wire externally; and conductive first and second holding members configured to hold an exposed braid at the terminal of the electric wire between the first and the second holding members, wherein the sub shield body has a first accommodation chamber that covers the electric wire connection portion and an exposed core wire at the terminal of the electric wire externally and a second accommodation chamber that covers the exposed braid at the terminal of the electric wire and the first and the second holding members externally, and the first and the second holding members are members holding, between the first and the second holding members along an axial line of the terminal of the electric wire, an annular development portion of the braid that is formed by annularly developing the exposed braid to an outer side in a radial direction, have annular holding portions interposing the annular development portion therebetween, and are pressed against and fixed to the shield member along a holding direction of the annular development portion.

According to another aspect of the present invention, in the connector, it is preferable that the first holding member has a smooth surface portion that makes surface contact with a wall surface of the second accommodation chamber.

According to still another aspect of the present invention, in the connector, it is preferable that the first holding member has a projecting portion that projects toward a wall surface of the second accommodation chamber and makes contact with the wall surface of the second accommodation chamber.

According to still another aspect of the present invention, in the connector, it is preferable that the first and the second holding members are formed so as to be fastened together to the shield member by fixing by screwing with axial force along the holding direction of the annular development portion and have external screw insertion holes through which an external screw portion to be used for the fixing by screwing is inserted and facing wall surfaces that are arranged so as to face each other along the holding direction around the external screw insertion holes, and any one of the facing wall surface of the first holding member and the facing wall surface of the second holding member has a locking projecting portion that annularly projects concentrically with the external screw insertion holes toward the counterpart facing wall surface arranged so as to face the facing wall surface in the holding direction and locks an outer end portion of the annular development portion in the radial direction.

According to still another aspect of the present invention, in the connector, it is preferable that the annular holding portion of the first holding member or the second holding member that has the locking projecting portion has an annular projecting portion projects annularly and concentrically toward the counterpart annular holding portion arranged so as to face the annular holding portion in the holding direction.

According to still another aspect of the present invention, in the connector, it is preferable that the connector comprises a plurality of combinations of the terminal fitting and the electric wire, wherein the first and the second holding members have the annular holding portions for the respective annular development portions of all of the electric wires, and the sub shield body has the first accommodation chambers for the respective combinations of the terminal fitting and the electric wire and the second accommodation chamber that accommodates the annular development portions of all of the electric wires together with the first and the second holding members.

In order to achieve the object, an electric wire with a connector according to still another aspect of the present invention includes an electric wire; a terminal fitting that has an electric connection portion configured to be electrically connected to a counterpart terminal of a counterpart connector and an electric wire connection portion configured to be electrically connected to a terminal of the electric wire; an insulating accommodation body configured to accommodate the electric connection portion in an internal accommodation space and allow the electric wire connection portion to project outward together with the terminal of the electric wire; a conductive shield member that has a main shield body covering the accommodation body externally and a sub shield body covering the electric wire connection portion and the terminal of the electric wire externally; and conductive first and second holding members configured to hold an exposed braid at the terminal of the electric wire between the first and the second holding members, wherein the sub shield body has a first accommodation chamber that covers the electric wire connection portion and an exposed core wire at the terminal of the electric wire externally and a second accommodation chamber that covers the exposed braid at the terminal of the electric wire and the first and the second holding members externally, and the first and the second holding members are members holding, between the first and the second holding members along an axial line of the terminal of the electric wire, an annular development portion of the braid that is formed by annularly developing the exposed braid to an outer side in a radial direction, have annular holding portions interposing the annular development portion therebetween, and are pressed against and fixed to the shield member along a holding direction of the annular development portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
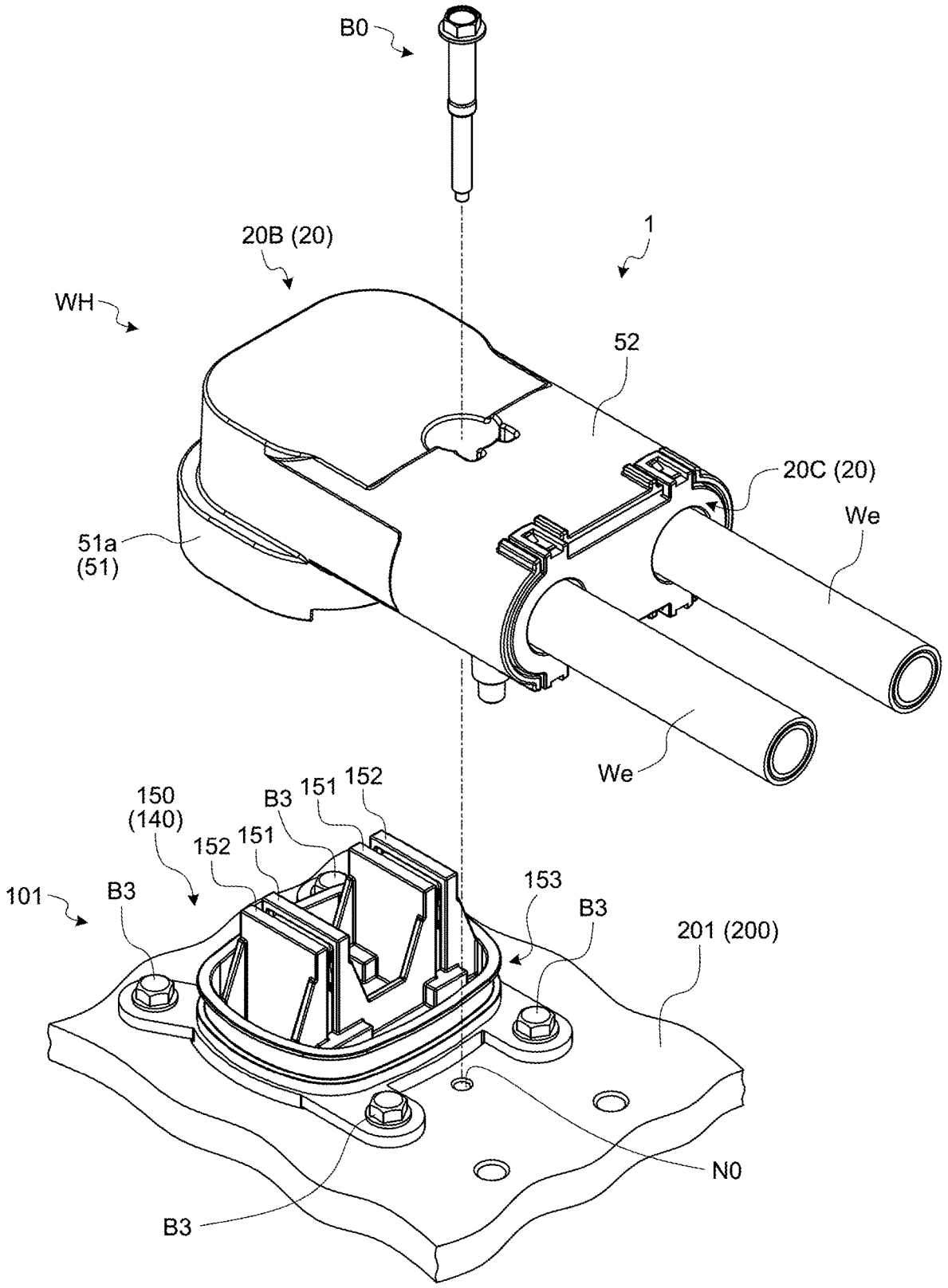
FIG. 1 is a perspective view illustrating a connector and an electric wire with the connector according to an embodiment together with a counterpart connector before connector fitting.

Hereinafter, an embodiment of a connector and an electric wire with the connector according to the present invention will be described in detail with reference to the drawings. Note that the embodiment does not limit this invention.

Embodiment

One embodiment of the connector and the electric wire with the connector according to the present invention will be described with reference to FIGS. 1 to 16.

A reference numeral 1 in FIGS. 1 to 4 indicates the connector in the embodiment. A reference numeral WH in FIGS. 1 to 4 indicates the electric wire with the connector configured by mounting the connector 1 on electric wires We in an electrically connected state.

The connector 1 is included in a connector device together with a counterpart connector 101 (FIG. 1). The connector device electrically connects connection targets that are electrically connected to a first connector and a second connector by physical and electric connection between the first connector and the second connector. In this example, the connector 1 is assumed to be the first connector and the counterpart connector 101 is assumed to be the second connector for the convenience.

The connection targets indicate, for example, a power supply circuit such as an inverter and an electric apparatus such as a rotating machine. For example, the connector 1 is electrically connected to the electric apparatus (not illustrated) via the electric wires We. On the other hand, the counterpart connector 101 is mounted on a housing 201 of a power supply circuit 200 (FIG. 1) and is electrically connected to the power supply circuit 200 via an electric wire (not illustrated). The connector 1 and the counterpart connector 101 are electrically connected to each other to electrically connect the electric apparatus and the power supply circuit 200, thereby supplying electric power to the electric apparatus from a power supply (secondary battery or the like) and charge the power supply with electricity generated in the electric apparatus.

The connector 1 in the embodiment is inserted and fitted into the counterpart connector 101 to be electrically connected to the counterpart connector 101. On the other hand, extraction of the connector 1 from the counterpart connector 101 cancels electric connection between the connector 1 and the counterpart connector 101. An insertion fitting direction is referred to as a "connector insertion direction" and an extraction direction is referred to as a "connector extraction direction". When both of these directions are not specified, they are referred to as a "connector insertion/extraction direction". As for these directions, when explanation is made based on the connector 1 as a subject, the direction of the connector 1 relative to the counterpart connector 101 is indicated whereas when explanation is made based on the counterpart connector 101 as the subject, the direction of the counterpart connector 101 relative to the connector 1 is indicated.

The connector 1 in the embodiment may be a female connector having a female terminal or may be a male connector having a male terminal as long as it has the configuration, which will be described in detail later. In the following example, the connector 1 is the male connector and the counterpart connector 101 is the female connector for explanation.

Figure 4:
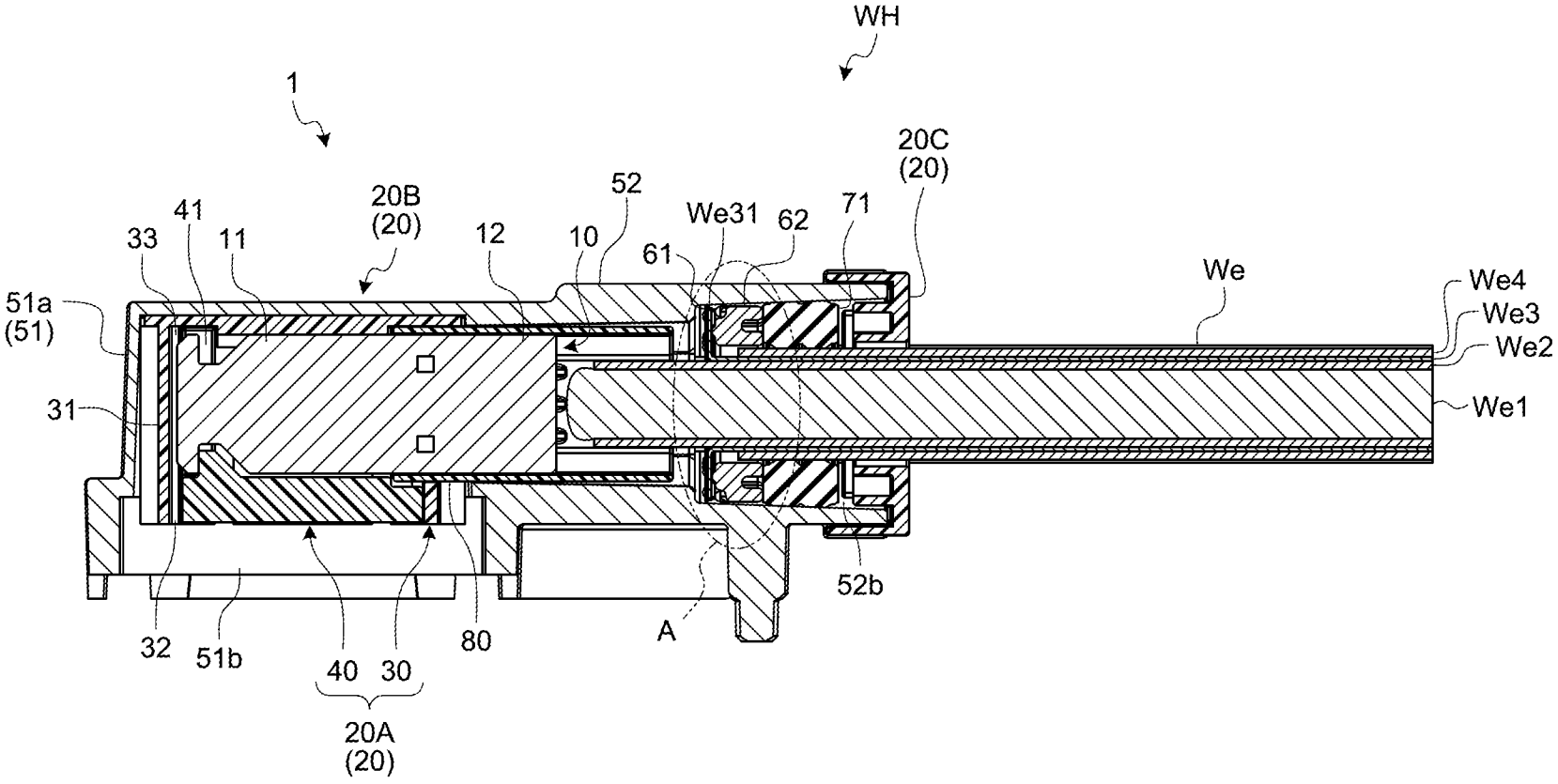
FIG. 4 is a cross-sectional view cut along line X1-X1 in FIG. 3.
Figure 5:
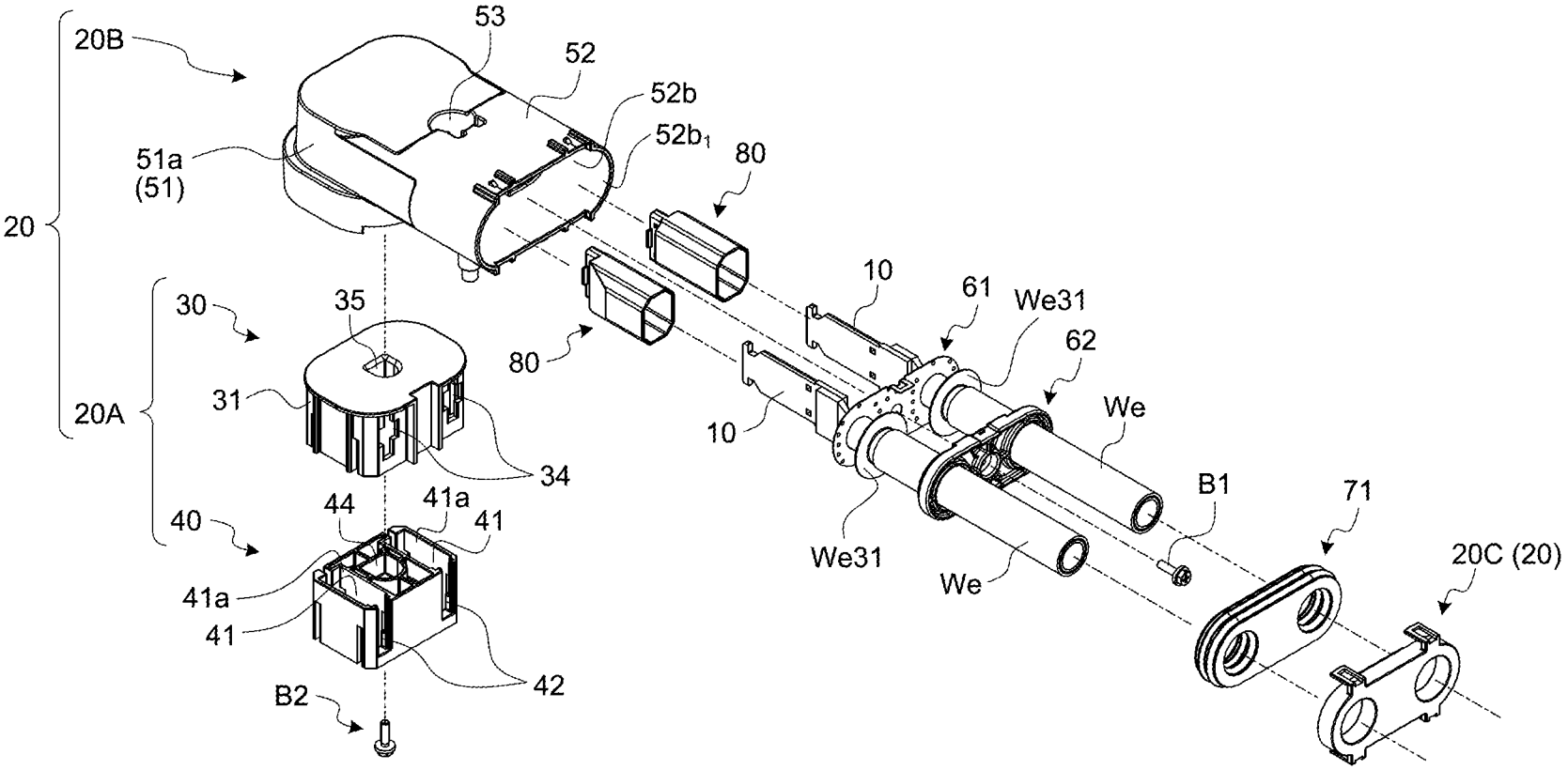
FIG. 5 is an exploded perspective view illustrating the connector in the embodiment together with electric wires.

The connector 1 in the embodiment includes terminal fittings 10 and a housing 20 (see FIGS. 4 and 5).

The terminal fittings 10 in the embodiment are made of a conductive material such as metal (copper, copper alloy, aluminum, aluminum alloy, or the like) and are shaped into male forms. In this example, the male terminal fittings 10 are shaped by press processing such as cutting and folding using a conductive metal plate as a base material. Each of the terminal fittings 10 has an electric connection portion 11 that is electrically connected to a counterpart terminal 110 of the counterpart connector 101, which will be described later, and an electric wire connection portion 12 that is electrically connected to the terminal of the electric wire We (see FIGS. 4 and 6).

Figure 6:
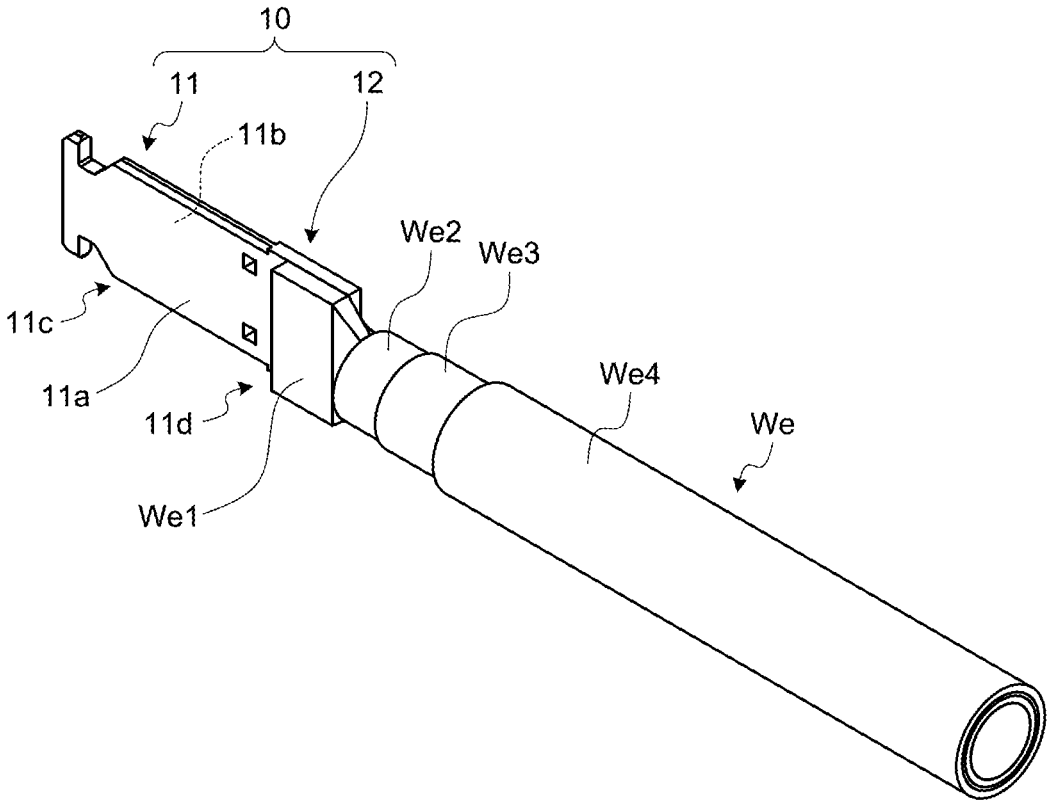
FIG. 6 is a perspective view illustrating the electric wire and a terminal fitting mounted on the electric wire.

The electric connection portion 11 in this example is formed into a male form. The electric connection portion 11 is formed into a flat plate shape having two flat wall surfaces (a first wall surface 11*a* and a second wall surface 11*b*) (FIG. 6). The electric connection portion 11 is formed into a rectangular flat plate shape, and the first wall surface 11*a* and the second wall surface 11*b* are arranged so as to face each other in a parallel state. The electric connection portion 11 uses, as a connecting point portion making physical and electric connection to the counterpart terminal 110, at least one of the first wall surface 11*a* and the second wall surface 11*b*. In this example, the counterpart terminal 110 has two electric connection portions (a first electric connection portion 121 and a second electric connection portion 122) as will be described later, and the first wall surface 11*a* and the second wall surface 11*b* are thereby used as the connection point portions so as to be electrically connected to the electric connection portions, respectively.

The electric wire connection portion 12 in this example is physically and electrically connected to the terminal of the electric wire We. The electric wire We is formed as what is called a shield electric wire. The electric wire We includes a core wire We1, a cylindrical insulating body We2 covering the core wire We1 concentrically, a conductive mesh braid We3 covering the insulating body We2 concentrically and shaped into a cylindrical form, and a cylindrical insulating coating We4 covering the braid We3 concentrically (see FIGS. 4 and 6). At the terminal of the electric wire We, the coating We4 is stripped off to expose the insulating body We2 and the braid We3, and the front end of the exposed insulating body We2 is stripped off to expose the core wire We1. The electric wire connection portion 12 is physically and electrically connected to the exposed core wire We1 at the terminal of the electric wire We. The electric wire connection portion 12 may be crimped to the exposed core wire We1 by caulking or the like or may be firmly fixed thereto by welding or the like. The electric wire connection portion 12 in this example is firmly fixed to the exposed core wire We1 by welding or the like.

The front ends of the terminal fittings 10 in this example are at the side of one end portions 11*c* of the electric connection portions 11 that are arranged so as to face each other and the electric wire connection portions 12 are arranged at the side of the other end portions 11*d* thereof (FIG. 6).

The connector 1 includes at least one combination of the terminal fitting 10 and the electric wire We. The connector in the embodiment includes the combinations for respective poles, for example. In this example, two combinations are provided (FIG. 5). Although the connector 1 includes the same terminal fittings 10 in the housing 20, the terminal fitting 10 in this example and a terminal fitting having a shape differing from the terminal fitting 10 in this example may be mixed.

Next, the housing 20 in the embodiment will be described.

The housing 20 in the embodiment includes an accommodation body 20A accommodating therein the terminal fittings 10 (see FIGS. 2 to 5 and 7). Furthermore, the housing 20 in the embodiment includes a shield shell 20B accommodating therein the accommodation body 20A to the terminals of the electric wires We and covering them externally (FIGS. 1 to 5). The housing 20 in the embodiment includes a holding member 20C preventing the terminal fittings 10 from being extracted from the accommodation body 20A at the side of the electric wires We (FIGS. 1 to 5).

First, the accommodation body 20A is described.

The accommodation body 20A is made of an insulating material such as synthetic resin. The accommodation body 20A accommodates the electric connection portions 11 in an accommodation space 33, which will be scribed later, and allows the electric wire connection portions 12 to project outward together with the terminals of the electric wires We. The accommodation body 20A in the embodiment is largely divided into a first accommodation member 30 and a second accommodation member 40 (FIGS. 2 to 5 and 7).

The first accommodation member 30 is shaped into a cylindrical form having at least one open end in the cylindrical axis direction. The first accommodation member 30 therefore has a cylindrical outer circumferential wall 31 (see FIGS. 4, 5, and 7). The first accommodation member 30 in this example has the outer circumferential wall 31 formed into a square cylindrical shape, and has the one open end and the other closed end in the cylindrical axis direction. In the first accommodation member 30, the counterpart terminals 110 are inserted into the accommodation space 33 (see FIGS. 2, 4, and 7) from an opening 32 (see FIGS. 2, 4, and 7) at the one end thereof along the cylindrical axis direction. Strictly speaking, the counterpart terminals 110 are inserted into the accommodation space 33 from the opening 32 through the second accommodation member 40, as will be described later.

Figure 7:
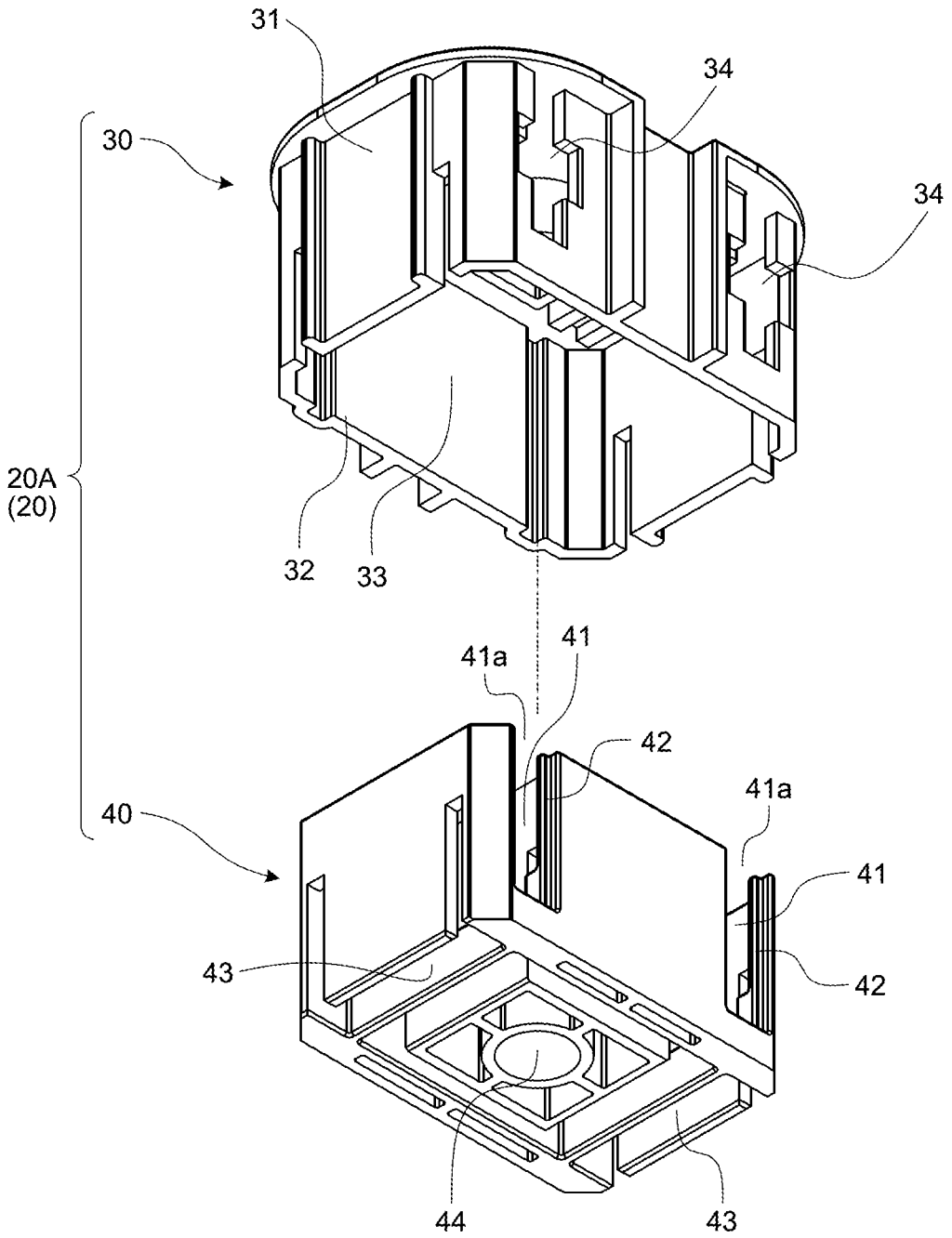
FIG. 7 is an exploded perspective view of an accommodation body.

The outer circumferential wall 31 has insertion holes 34 through which the terminal fittings 10 are inserted into the accommodation space 33 from the front ends thereof at the side of the electric connection portions 11 (see FIGS. 5 and 7). The first accommodation member 30 in this example accommodates the electric connection portions 11 in the accommodation space 33 and allows the electric wire connection portions 12 to project outward from the insertion holes 34 (see FIG. 4).

The insertion holes 34 are provided for the respective terminal fittings 10. Two insertion holes 34 are therefore formed in the outer circumferential wall 31 in this example (see FIGS. 5 and 7). The insertion holes 34 are formed and arranged such that the terminal fittings 10 are inserted thereinto with their axial line directions oriented to the same direction. That is to say, the axial line directions of the terminal fittings 10 correspond to the insertion directions (hereinafter, referred to as "terminal insertion directions") of the terminal fittings 10 into the accommodation space 33. Furthermore, the insertion holes 34 are formed and arranged such that the terminal fittings 10 are inserted from the front ends thereof at the side of the electric connection portions 11 in a state in which the first and the second wall surfaces 11*a* and 11*b* are made along the cylindrical axis direction of the outer circumferential wall 31.

Figure 8:
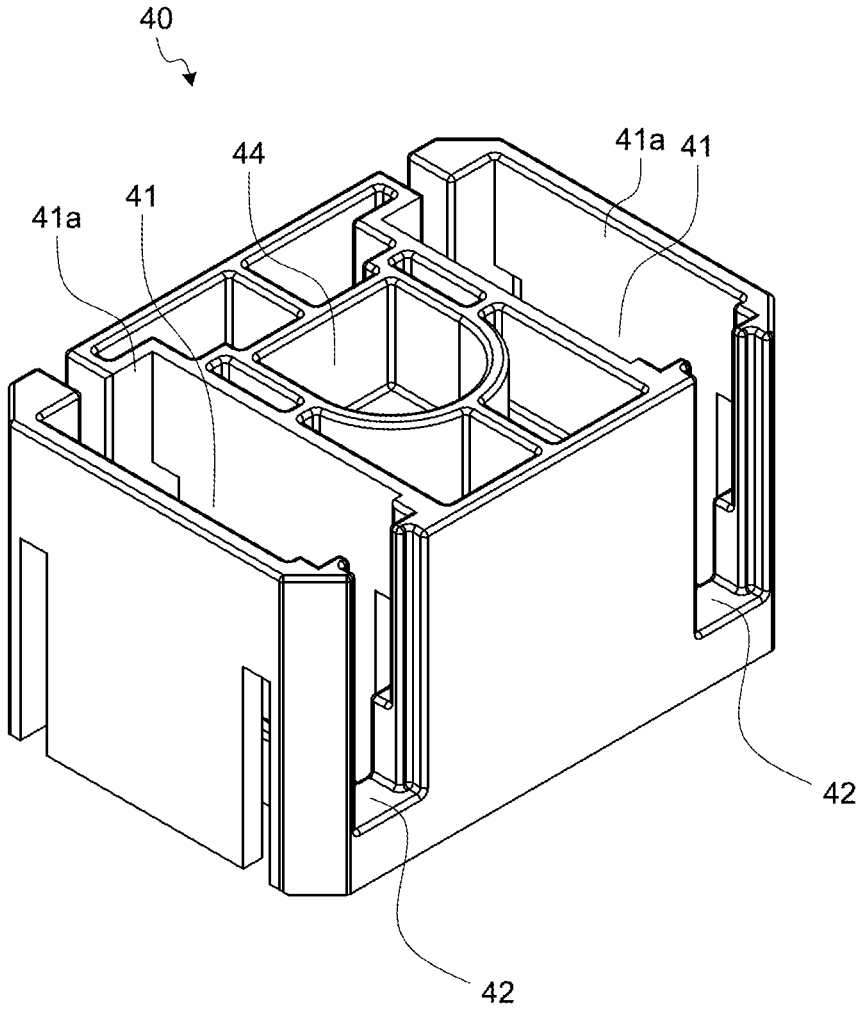
FIG. 8 is a perspective view illustrating a second accommodation member when seen from another angle.

The second accommodation member 40 is shaped into a polyhedral body corresponding to the shape of the accommodation space 33 of the first accommodation member 30 (FIGS. 7 and 8). The second accommodation member 40 is accommodated in the accommodation space 33 along the cylindrical axis direction from the opening 32 of the first accommodation member 30 (FIGS. 2, 4, 5, and 7). The second accommodation member 40 accommodates therein the electric connection portions 11 of the terminal fittings 10 in a state of being completely accommodated in the accommodation space 33 (FIG. 4).

The second accommodation member 40 has terminal accommodation chambers 41 accommodating therein the electric connection portions 11 in the accommodation space 33 (FIGS. 4, 5, 7, and 8). The terminal accommodation chambers 41 start accommodating the electric connection portions 11 accommodated in the accommodation space 33 from openings 41*a* (FIGS. 5, 7, and 8) as the second accommodation member 40 is inserted into the accommodation space 33. When the second accommodation member 40 is completely accommodated in the accommodation space 33, the terminal accommodation chambers 41 completely accommodate the electric connection portions 11. The second accommodation member 40 therefore has cutout portions 42 that allow the terminal accommodation chambers 41 to communicate with the outside thereof at the outer circumferential surface side (FIGS. 5, 7, and 8). The electric wire connection portions 12 project to the outside of the second accommodation member 40 from the cutout portions 42. The cutout portions 42 are arranged so as to face the insertion holes 34 in the state in which the second accommodation member 40 is accommodated in the accommodation space 33 such that the electric wire connection portions 12 project to the outside from the insertion holes 34 of the first accommodation member 30.

Figure 2:
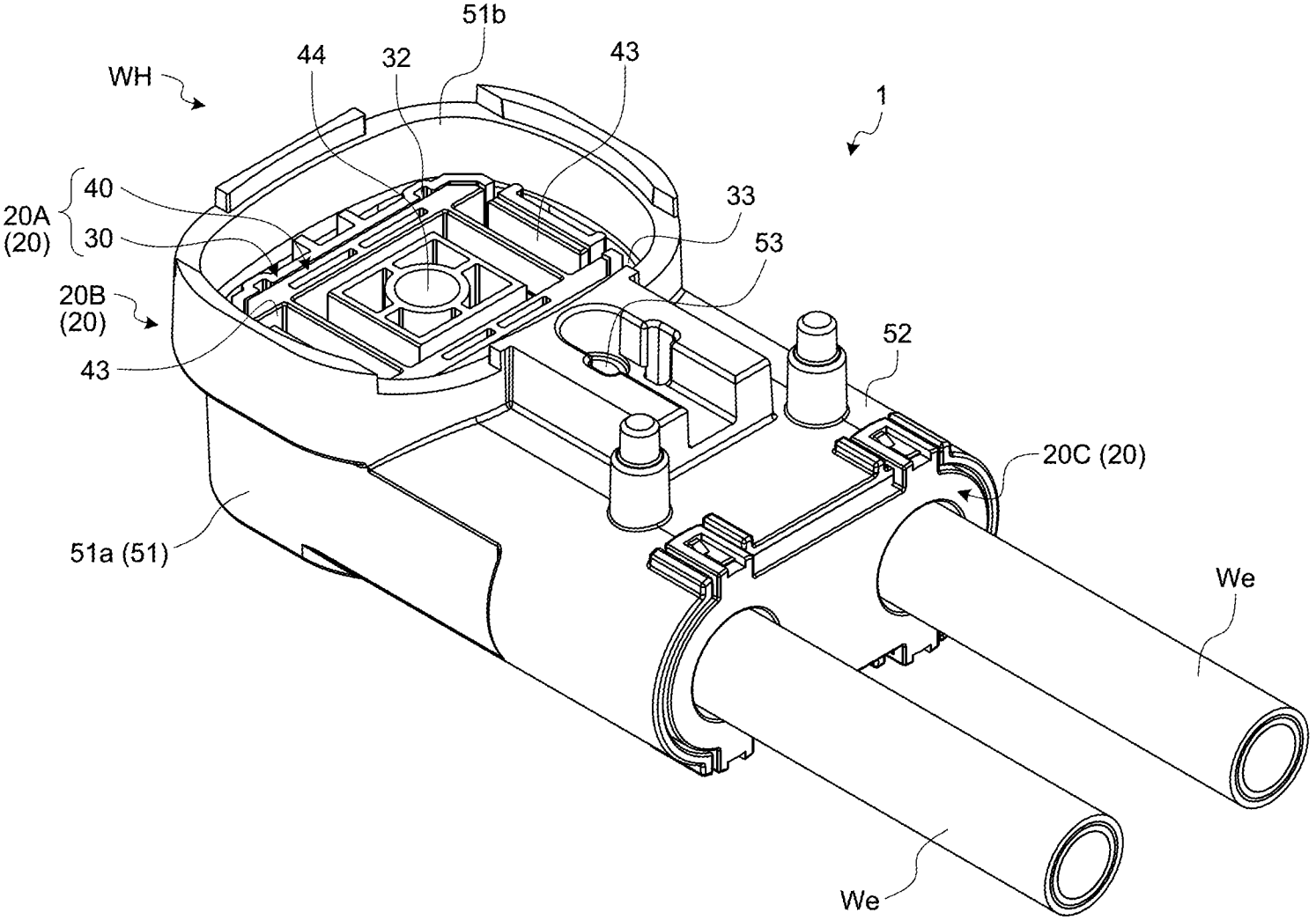
FIG. 2 is a perspective view illustrating the connector and the electric wire with the connector in the embodiment when seen from another angle.
Figure 3:
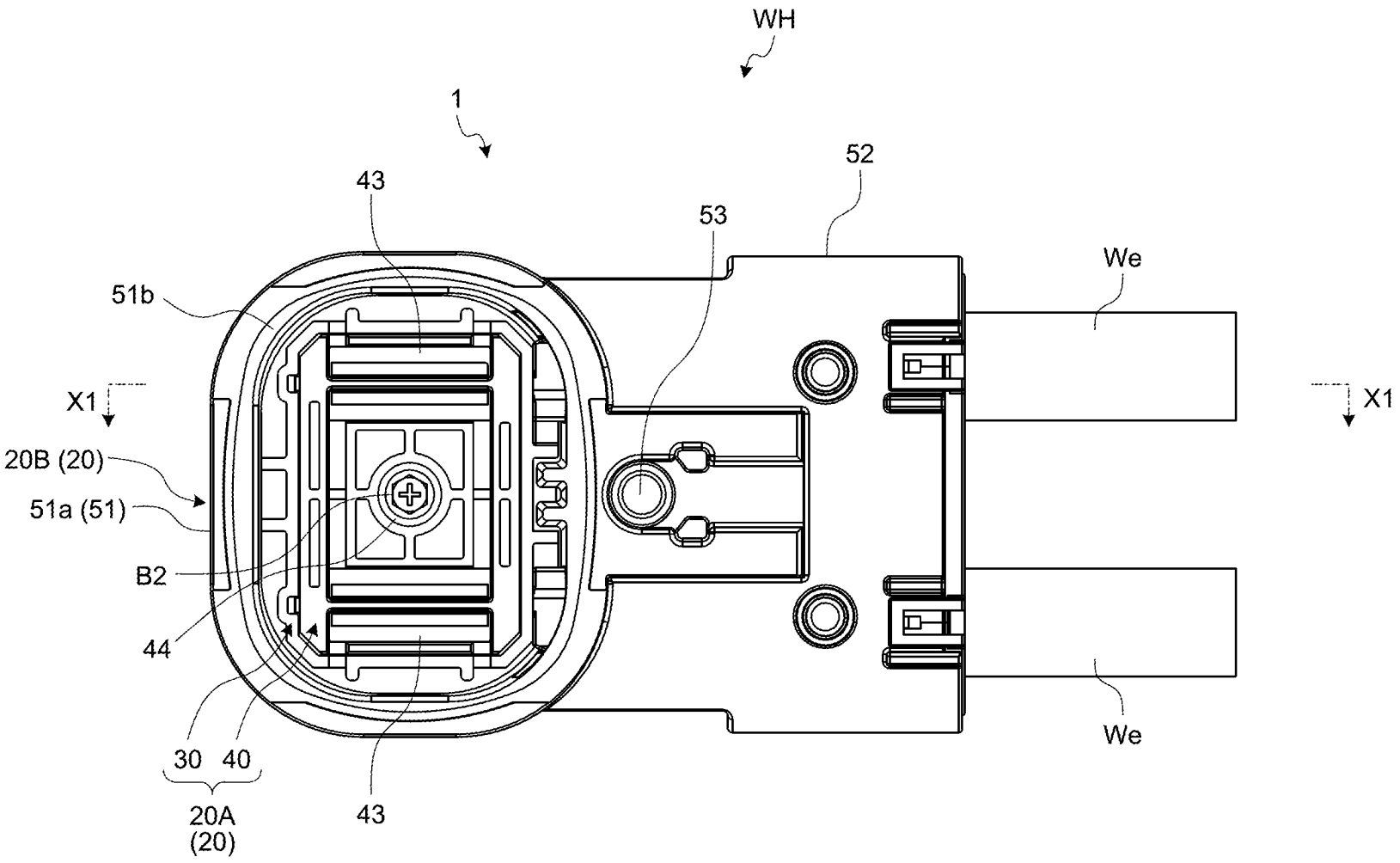
FIG. 3 is a plan view illustrating the connector and the electric wire with the connector in the embodiment when seen from a terminal insertion port side.

When fitting between the connector 1 and the counterpart connector 101 (hereinafter, referred to as "connector fitting") is completed, the terminal accommodation chambers 41 accommodate therein the first and the second electric connection portions 121 and 122 and the two connection point members 130 of the counterpart connector 110, which will be described later. In the terminal accommodation chambers 41, the connection point members 130 respectively make contact with the first wall surfaces 11*a* and the second wall surfaces 11*b* of the electric connection portions 11 to establish physical and electric connection therebetween. The second accommodation member 40 therefore has terminal insertion ports 43 that allow the counterpart terminals 110 to be inserted into the terminal accommodation chambers 41 (FIGS. 2, 3, and 7). The terminal insertion ports 43 are formed so as to be arranged at the side of the opening 32 of the first accommodation member 30 in the state in which the second accommodation member 40 is accommodated in the accommodation space 33, and is arranged so as to face the terminal accommodation chambers 41 in the cylindrical axis direction of the outer circumferential wall 31. In the second accommodation member 40, the terminal accommodation chambers 41 and the terminal insertion ports 43 communicate with each other in the cylindrical axis direction of the outer circumferential wall 31.

In the second accommodation member 40, combinations of the terminal accommodation chamber 41, the cutout portion 42, and the terminal insertion port 43 are provided for the respective terminal fittings 10. The combinations are arranged such that the terminal insertion directions of the terminal fittings 10 into the accommodation space 33 are the same. In this example, two combinations are provided.

Next, the shield shell 20B is described.

The shield shell 20B is a shield member that substantially prevents noise from entering, from the outside, the accommodation body 20A to the terminals of the electric wires We. The shield shell 20B accommodates therein the accommodation body 20A to the terminals of the electric wires We and covers them externally. The shield shell 20B is made of a conductive material such as metal. The shield shell 20B has a main shield body 51 that is exposed at the opening 32 side and covers the accommodation body 20A externally and a sub shield body 52 that externally covers the electric wire connection portions 12 and the terminals of the electric wires We projecting to the outside of the accommodation body 20A from the insertion holes 34 (FIGS. 1, 5, and 9).

Figure 9:
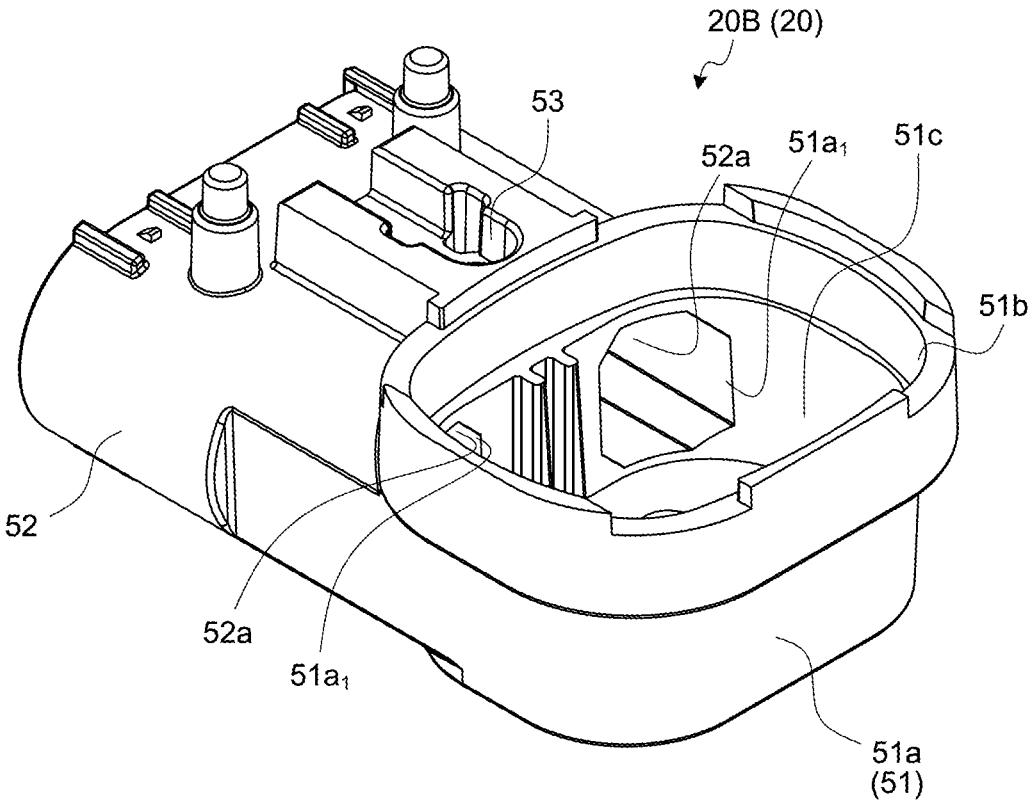
FIG. 9 is a perspective view of a shield shell.

The main shield body 51 has a cylindrical outer circumferential wall 51*a* having one open end and the other closed end (FIGS. 1, 5, and 9). The outer circumferential wall 51*a* in this example is formed into a square cylindrical shape corresponding to the outer shape of the first accommodation member 30 having the square cylindrical shape. In the main shield body 51, the first accommodation member 30 is inserted into an accommodation space 51*c* (see FIG. 9) therein from an opening 51*b* (FIGS. 2, 4, and 9) at the one end thereof along the cylindrical axis directions thereof.

The outer circumferential wall 51*a* has through-holes $51a_1$ that are arranged so as to face the insertion holes 34 in a state in which the first accommodation member 30 is accommodated in the accommodation space 51*c* (FIG. 9).

The through-holes 51$a_1$ are provided for the respective terminal fittings 10. In this example, two through-holes 51$a_1$ are provided.

The sub shield body 52 projects from the outer circumferential wall 51*a* of the main shield body 51. The sub shield body 52 has first accommodation chambers 52*a* (FIG. 9) and a second accommodation chamber 52*b* (FIG. 5).

Figure 10:
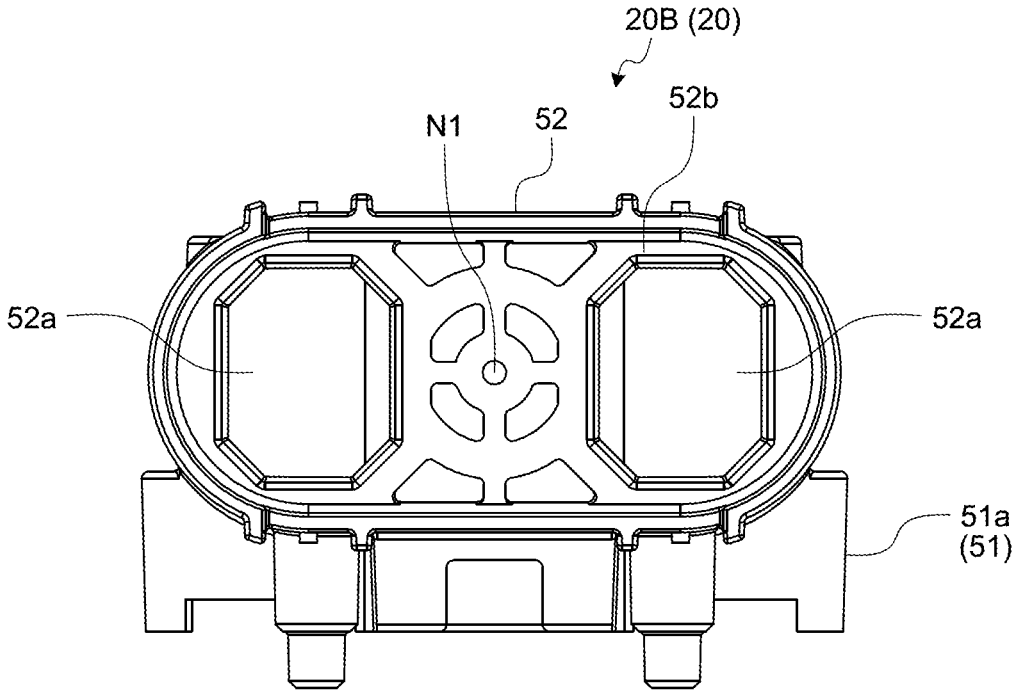
FIG. 10 is a plan view of the shield shell.

The first accommodation chambers 52*a* are spaces accommodating therein the electric wire connection portions 12 and the exposed core wires We1 at the terminals of the electric wires We and covering them externally. The first accommodation chambers 52*a* are provided for the respective combinations of the terminal fitting 10 and the electric wire We (FIG. 10). The first accommodation chambers 52*a* in this example are formed into cylindrical shapes and are made to communicate with the through-holes 51$a_1$ of the main shield body 51. In the sub shield body 52, two first accommodation chambers 52*a* are arranged in parallel with the axial line directions oriented to the same direction.

The second accommodation chamber 52*b* is a space accommodating therein the exposed braids We3 at the terminals of the electric wires We and covering them externally. The second accommodation chamber 52*b* is formed so as to accommodate therein portions at the terminals of all of the electric wires We except for the exposed core wires We1 (FIG. 10). The second accommodation chamber 52*b* in this example is formed as an internal space of the square cylindrical portion and is made to communicate with the first accommodation chambers 52*a*. The second accommodation chamber 52*b* has an opening 52$b_1$ that is arranged so as to face the first accommodation chambers 52*a* in an end portion of the sub shield body 52 at the free end side (FIG. 5). The terminal fittings 10 are inserted into the second accommodation chamber 52*b* from the opening 52$b_1$. The holding member 20C is a square cylindrical member formed so as to close the opening 52$b_1$ and allow the electric wires We to be extended to the outer side therethrough. The holding member 20C is fitted into the end portion of the sub shield body 52 at the free end side.

Figure 11:
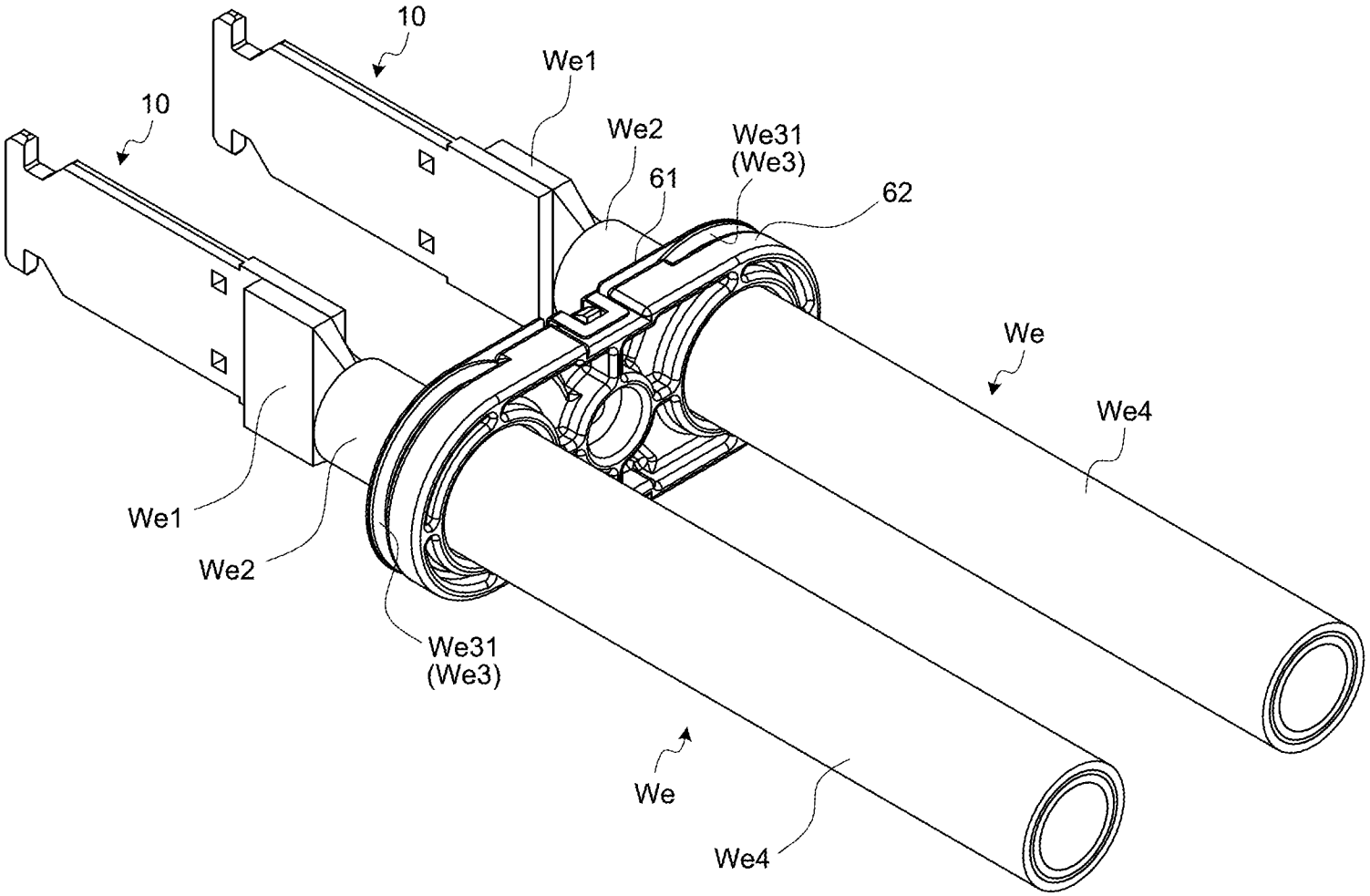
FIG. 11 is a perspective view illustrating a holding state of annular development portions between first and second holding members.
Figure 12:
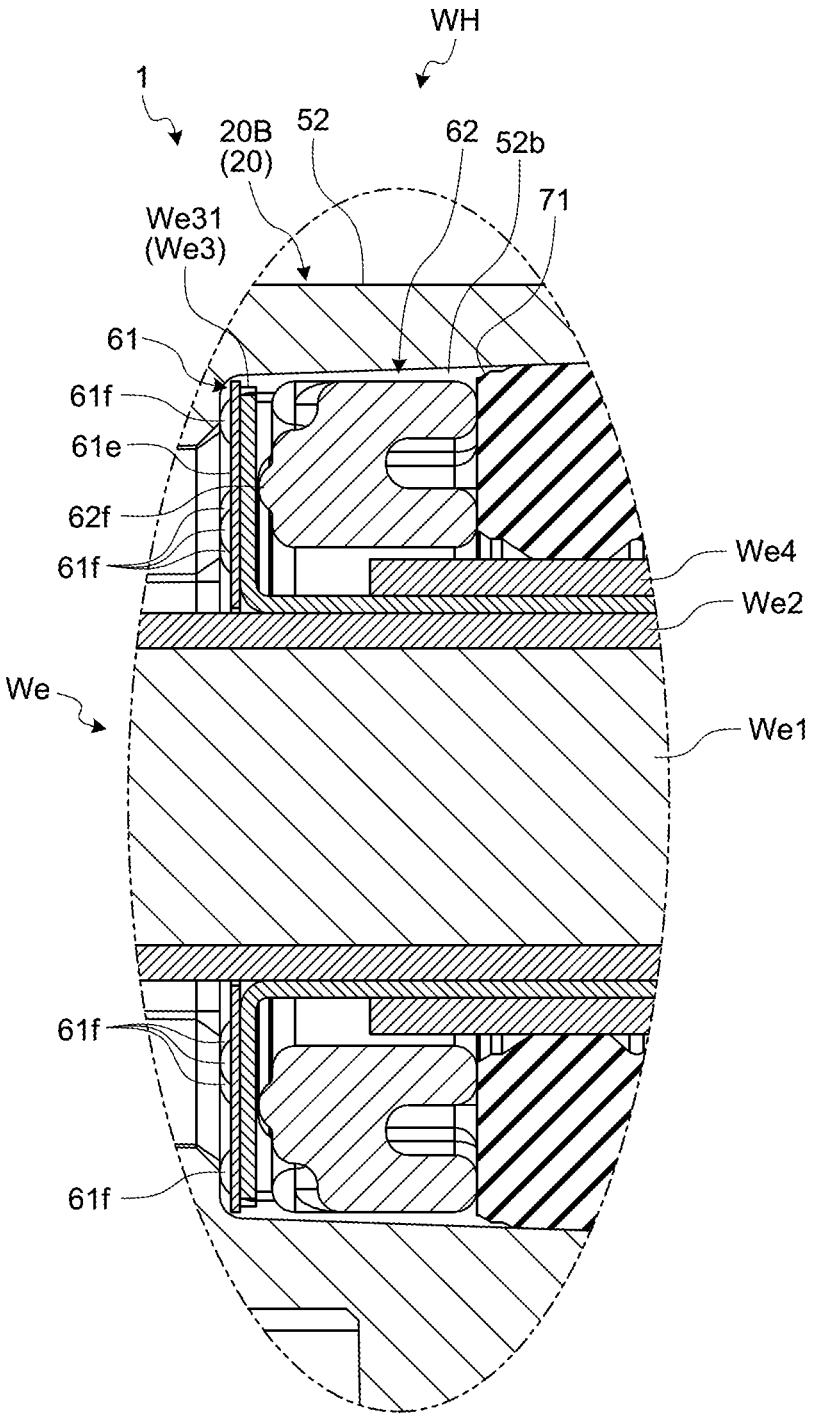
FIG. 12 is an enlarged view of an A part in FIG. 4.

The connector 1 includes first and second holding members 61 and 62 that hold the exposed braids We3 at the terminals of the electric wires We therebetween in the second accommodation chamber 52*b* thereof (FIGS. 4, 5, and 11 to 14). The first and the second holding members 61 and 62 are made of a conductive material such as metal. The exposed braids We3 are developed in annular forms to the outer side in the radial direction in the second accommodation chamber 52*b*. The first and the second holding members 61 and 62 hold therebetween annular development portions We31 of the braids We3 that are developed in the annular forms along the axial lines of the terminals of the electric wires We (FIGS. 4, 11, and 12).

Figure 13:
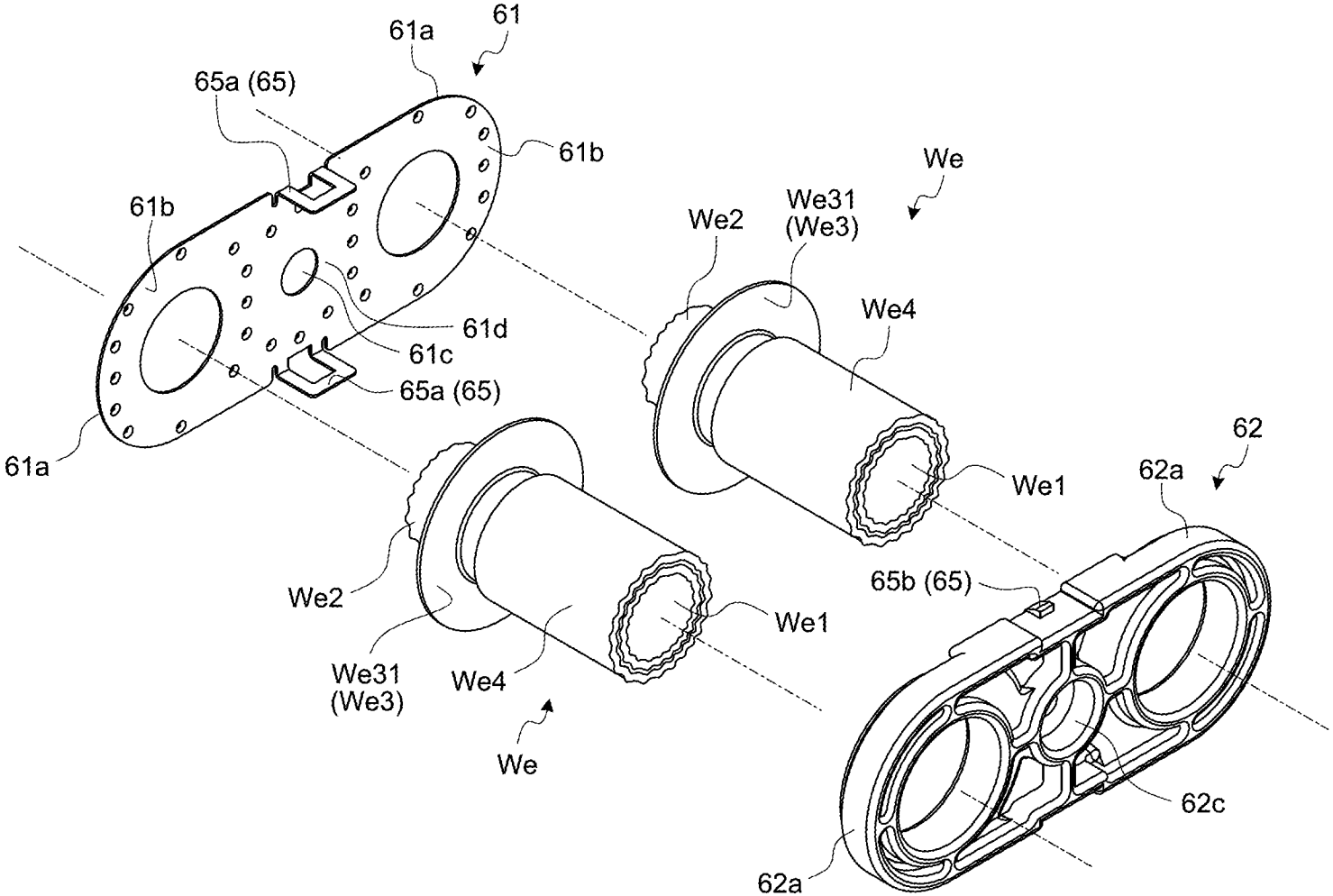
FIG. 13 is an exploded perspective view illustrating the first and the second holding members and the annular development portions.
Figure 14:
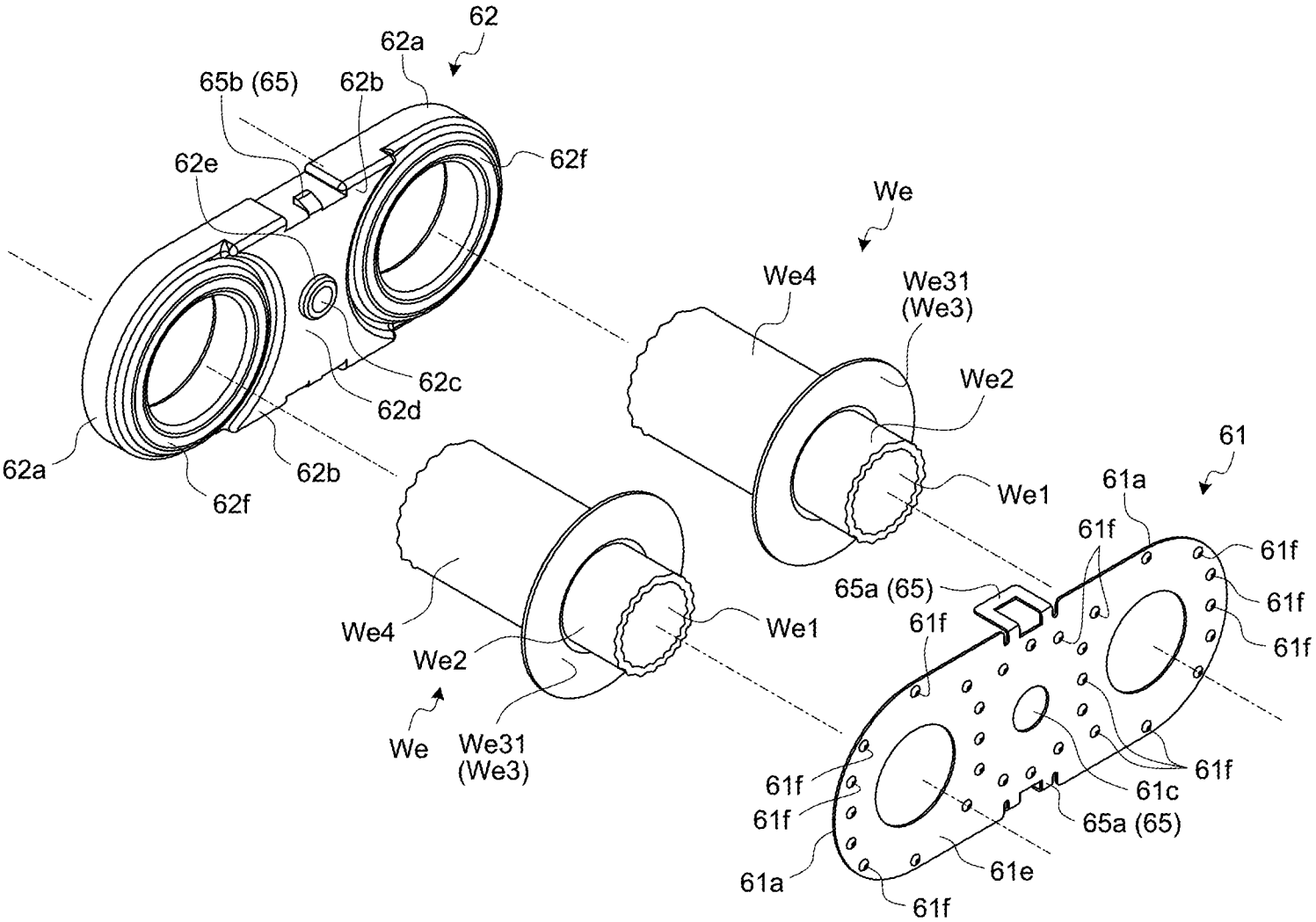
FIG. 14 is an exploded perspective view illustrating the first and the second holding members and the annular development portions when seen from another angle.

The first and the second holding members 61 and 62 have annular holding portions 61*a* and 62*a* that interpose the annular development portions We31 therebetween (FIGS. 13 and 14). The first and the second holding members 61 and 62 have the annular holding portions 61*a* and 62*a* for the respective annular development portions We31 of all of the electric wires We. In this example, two annular holding portions 61*a* and two annular holding portions 62*a* are formed. The annular holding portions 61*a* and 62*a* respectively have wall surfaces (hereinafter, referred to as "annular holding surfaces") 61*b* and 62*b* that are arranged so as to face each other along the holding direction of the annular development portions We31 (FIGS. 13 and 14). The annular development portions We31 are held between the respective annular holding surfaces 61*b* and 62*b*.

The first and the second holding members 61 and 62 are accommodated in the second accommodation chamber 52*b* in the state of interposing the annular development portions We31 therebetween. Accordingly, the second accommodation chamber 52*b* is also a space accommodating therein, in addition to the exposed braids We3 (annular development portions We31) at the terminals of the electric wires We, the first and the second holding members 61 and 62 and covering them externally. The second accommodation chamber 52*b* in this example accommodates therein the annular development portions We31 of all of the electric wires We together with the first and the second holding members 61 and 62. The first and the second holding members 61 and 62 are pressed against and fixed to the shield shell 20B along the holding direction of the annular development portions We31 in the second accommodation chamber 52*b*. The first and the second holding members 61 and 62 may employ a desired method for fixing as long as they are fixed along the holding direction as described above. As the fixing method, for example, fixing by screwing, fixing by fitting, fixing by pressing the first and the second holding members 61 and 62 toward the shield shell 20B with another member and interposing them between the member and the shield shell 20B, and the like can be considered. The first and the second holding members 61 and 62 in this example are fastened together to the shield shell 20B by fixing by screwing with axial force along the holding direction of the annular development portions We31. The first and the second holding members 61 and 62 therefore have through-holes (hereinafter, referred to as "external screw insertion holes") 61*c* and 62*c* through which an external screw portion of an external screw member B1 (FIG. 5) is inserted and facing wall surfaces 61*d* and 62*d* that are arranged so as to face each other along the holding direction of the annular development portions We31 around the external screw insertion holes 61*c* and 62*c* (FIGS. 13 and 14), respectively. The sub shield body 52 of the shield shell 20B has an internal screw portion N1 with which the external screw member B1 is screwed (FIG. 10).

As described above, the connector 1 and the electric wire with the connector WH in the embodiment do not require crimping processing unlike the conventional techniques because the exposed braids We3 (annular development portions We31) at the terminals of the electric wires We are held between the first and the second holding members 61 and 62 only. The connector 1 and the electric wire with the connector WH can therefore improve endurance of the electric wires We because no unnecessary load acts on the core wires We1. Furthermore, the connector 1 and the electric wire with the connector WH can be reduced in size along the axial line directions of the terminals of the electric wires We because the braids We3 are not folded back unlike the conventional technique. The connector 1 and the electric wire with the connector WH require no cylindrical member (that receives the force with the crimping of the cylindrical shield member) unlike the conventional techniques. Furthermore, in the connector 1 and the electric wire with the connector WH, the braids We3 are grounded through the shield shell 20B by mounting the first and the second holding members 61 and 62 on the shield shell 20B. That is to say, the connector 1 and the electric wire with the connector WH can improve the endurance and the shield performance of the electric wires We while being reduced in size.

To be specific, the first holding member 61 in this example is provided as a plate-like member by press forming using a metal plate as a base material. The first holding member 61 is formed into a track shape corresponding to the shape of the second accommodation chamber 52*b*.

The first holding member 61 has a smooth surface portion 61*e* that makes surface contact with the wall surface of the second accommodation chamber 52*b* (FIGS. 12 and 14). The smooth surface portion 61*e* in this example makes surface contact with the wall surface of the second accommodation chamber 52*b* by being fixed through screwing. The connector 1 and the electric wire with the connector WH can reduce sliding abrasion between the wall surface of the second accommodation chamber 52*b* and the smooth surface portion 61*e* when vibration is generated, thereby reducing increase in shield resistance. The smooth surface portion 61*e* however cannot make surface contact with the wall surface, unless the wall surface of the second accommodation chamber 52*b* is smooth, for example, and a desired contact state is possibly not provided.

To deal with this situation, the first holding member 61 in this example has projecting portions 61*f* that project toward the wall surface of the second accommodation chamber 52*b* and make contact with the wall surface of the second accommodation chamber 52*b* (FIGS. 12 and 14). The projecting portions 61*f* in this example make contact with the wall surface of the second accommodation chamber 52*b* by being fixed through screwing. The projecting portions 61*f* are what is called indents formed into semi-spherical shapes or the like, and are provided on the smooth surface portion 61*e*. The projecting portions 61*f* are formed around the axes of the annular holding portions 61*a* on the smooth surface portion 61*e*. In this example, the projecting portions 61*f* are formed around the axes of the annular holding portions 61*a* with intervals. Furthermore, the projecting portions 61*f* are formed around the axis of the external screw insertion hole 61*c* on the smooth surface portions 61*e* also on the periphery of the external screw insertion hole 61*c*. In this example, the projecting portions 61*f* are formed around the axis of the external screw insertion hole 61*c* with intervals. In the connector 1 and the electric wire with the connector WH, the first holding member 61 can therefore be caused to make contact with the wall surface of the second accommodation chamber 52*b* reliably. In the connector 1 and the electric wire with the connector WH, the projecting portions 61*f* make point contact with the wall surface of the second accommodation chamber 52*b*. In the connector 1 and the electric wire with the connector WH, the first holding member 61 is fixed (in this example, by fixing by screwing) to the wall surface of the second accommodation chamber 52*b*, thereby reducing sliding abrasion between the wall surface of the second accommodation chamber 52*b* and the projecting portions 61*f* when vibration is generated and reducing increase in the shield resistance.

On the other hand, the second holding member 62 in this example is provided as a rigid body made of metal such as aluminum. The second holding member 62 is formed into a track shape corresponding to the shape of the second accommodation chamber 52*b*.

The first holding member 61 and the second holding member 62 are integrated with each other using lock mechanisms 65 in a state of interposing the annular development portions We31 therebetween (FIGS. 13 and 14). Each lock mechanism 65 includes a first locking portion 65*a* provided on the first holding member 61 and a second locking portion 65*b* provided on the second holding member 62. The lock mechanisms 65 are provided at two places, and the first locking portions 65*a* and the second locking portions 65*b* are engaged with each other to thereby integrate the first holding member 61 and the second holding member 62 with each other. The first locking portions 65*a* have locking holes, for example. The second locking portions 65*b* have claw portions that are inserted into the locking holes of the first locking portions 65*a*.

The first holding member 61 and the second holding member 62 are formed so as not to inhibit insertion of the external screw member B1 into the external screw insertion holes 61*c* and 62*c*. For example, a locking projecting portion is provided on any one of the facing wall surface 61*d* of the first holding member 61 and the facing wall surface 62*d* of the second holding member 62, and the locking projecting portion prevents the annular development portions We31 from closing the external screw insertion holes 61*c* and 62*c*. The locking projecting portion is a projecting portion that annularly projects concentrically with the external screw insertion holes 61*c* and 62*c* toward the counterpart facing wall surface arranged so as to face it in the holding direction of the annular development portions We31, and locks outer end portions of the annular development portions We31 in the radial direction. The annular holding portion of the first holding member 61 or the second holding member 62 that has the locking projecting portion has an annular projecting portion that annularly projects concentrically toward the counterpart annular holding portion arranged so as to face it in the holding direction of the annular development portions We31. The annular projecting portion guides the outer end portions of the annular development portions We31 in the radial direction toward the locking projecting portion. In this example, a locking projecting portion 62*e* and an annular projecting portions 62*f* are provided on the second holding member 62 (FIG. 14).

The locking projecting portion 62*e* projects from the facing wall surface 62*d* of the second holding member 62. The locking projecting portion 62*e* is a projecting portion that annularly projects concentrically with the external screw insertion hole 62*c* toward the counterpart facing wall surface 61*d* arranged so as to face it in the holding direction of the annular development portions We31, and locks the outer end portions of the annular development portions We31 in the radial direction. The locking projecting portion 62*e* locks the outer end portions of the annular development portions We31 in the radial direction such that the annular development portions We31 do not close the external screw insertion holes 61*c* and 62*c* when the annular development portions We31 are interposed between the first holding member 61 and the second holding member 62 and extend outward in the radial direction. In the connector 1 and the electric wire with the connector WH, the annular development portions We31 do not close the external screw insertion holes 61*c* and 62*c*, so that contact between the annular development portions We31 and the external screw member B1 is avoided and the first holding member 61 and the second holding member 62 can be fixed by screwing to the wall surface of the second accommodation chamber 52*b* in the state of interposing the annular development portions We31 therebetween.

The annular projecting portions 62*f* project from the annular holding surfaces 62*b* of the annular holding portions 62*a* of the second holding member 62. The annular projecting portions 62*f* annularly project concentrically toward the annular holding surfaces 61*b* of the counterpart annular holding portions 61*a* arranged so as to face them in the holding direction of the annular development portions We31. The annular projecting portions 62*f* incline the outer end portions of the annular development portions We31 in the radial direction to the side of the annular holding surfaces 62*b* when the annular development portions We31 are interposed between the first holding member 61 and the second holding member 62. The annular projecting portions 62*f* can thereby guide the end portions of the annular development portions We31 toward the outer circumferential wall of the locking projecting portion 62*e* such that the end portions of the annular development portions We31 do not climb over the locking projecting portion 62*e*. In the connector 1 and the electric wire with the connector WH, the annular development portions We31 do not close the external screw insertion holes 61*c* and 62*c* with this configuration, so that contact between the annular development portions We31 and the external screw member B1 is avoided and the first holding member 61 and the second holding member 62 can be fixed by screwing to the wall surface of the second accommodation chamber 52*b* in the state of interposing the annular development portions We31 therebetween.

A packing 71 is accommodated in the second accommodation chamber 52*b* after the first holding member 61 and the second holding member 62 are fixed by screwing (FIGS. 4 and 5). In the connector 1, for example, a member arranged at the position of the packing 71 may be used as another member mentioned above and the first and the second holding members 61 and 62 may be pressed toward the shield shell 20B by the member and be interposed between the member and the shield shell 20B for fixing.

In the connector 1, the electric wire connection portions 12 of the terminal fittings 10 are made to project from the insulating accommodation body 20A, and the conductive sub shield body 52 covers the projecting electric wire connection portions 12, as described above. Accordingly, in the connector 1, an insulating body is interposed between the conductive electric wire connection portions 12 and the sub shield body 52 to increase an insulating distance (a space distance and a creepage distance) therebetween. The connector 1 includes, as the insulating body, insulating cylindrical members (hereinafter, referred to as "insulating cylinders") 80 covering the electric wire connection portions 12 and the terminals of the electric wires We externally (FIGS. 4 and 5). The insulating cylinders 80 are made of an insulating material such as synthetic resin.

In the connector 1, the first accommodation member 30 is accommodated in the accommodation space 51*c* of the main shield body 51 and the terminal fittings 10 mounted on the terminals of the electric wires We and inserted into the insulating cylinders 80 are accommodated in the accommodation space 33 of the first accommodation member 30 from the front ends thereof. In the connector 1, the second accommodation member 40 is inserted into the accommodation space 33 in this state. In the connector 1, the first accommodation member 30, the second accommodation member 40, and the shield shell 20B are fixed by screwing in order to keep fixed states of these components. The main shield body 51 in this example has an internal screw portion (not illustrated) having an axial line being the cylindrical axis direction of the main shield body 51, for example. The first accommodation member 30, the second accommodation member 40, and the shield shell 20B are fixed by screwing an external screw member B2 (FIG. 5) with the internal screw portion. A through-hole 35, through which the external screw member B2 is inserted, is formed in the first accommodation member 30 (FIG. 5). A through-hole 44, through which the external screw member B2 is inserted, is formed in the second accommodation member 40 (FIGS. 2, 3, and 5). The through-holes 35 and 44 have axial lines being the cylindrical axis direction of the outer circumferential wall 31. The first accommodation member 30, the second accommodation member 40, and the shield shell 20B are thereby fastened together with axial force in the cylindrical axis direction.

The above-mentioned connector 1 is inserted and fitted into the counterpart connector 101 to be electrically connected to the counterpart connector 101, as described above. The following describes the counterpart connector 101 with reference to FIG. 15.

The counterpart connector 101 includes the counterpart terminals 110 that are electrically connected to the terminal fittings 10. The counterpart terminals 110 are provided for the respective terminal fittings 10. The counterpart connector 101 in this example includes two counterpart terminals 110.

The counterpart terminals 110 may use themselves as the connection point portions. In this case, terminal fittings (hereinafter, referred to as "counterpart terminal fittings") 120 themselves are the counterpart terminals 110. Alternatively, the counterpart terminals 110 may be formed by mounting the connection point members 130 on the counterpart terminal fittings 120. The counterpart terminals 110 in this example are configured by the counterpart terminal fittings 120 and the connection point members 130.

The counterpart terminal fittings 120 are made of a conductive material such as metal (copper, copper alloy, aluminum, aluminum alloy, or the like) and are shaped into female types. In this example, the female counterpart terminal fittings 120 are shaped by press processing such as cutting and folding using a conductive metal plate as a base material.

Each of the counterpart terminal fittings 120 has the first electric connection portion 121 and the second electric connection portion 122 arranged so as to face each other with a space therebetween. Each of the first electric connection portion 121 and the second electric connection portion 122 is formed into a flat plate shape having two flat wall surfaces. In this example, each of the first electric connection portion 121 and the second electric connection portion 122 is formed into a substantially rectangular flat plate shape. Furthermore, the first electric connection portion 121 and the second electric connection portion 122 in this example are formed into equivalent shapes. In each counterpart terminal fitting 120, one wall surfaces (hereinafter, referred to as "facing wall surfaces") of the two wall surfaces of the first electric connection portion 121 and the second electric connection portion 122 are arranged so as to face each other with the space therebetween. The electric connection portion 11 is inserted into between the facing wall surfaces of each counterpart terminal fitting 120, and the facing wall surfaces and the first and the second wall surfaces 11*a* and 11*b* are arranged so as to face each other. The counterpart terminal fittings 120 are fixed to a housing 140, which will be described, by screwing or the like.

Different connection point members 130 may be used for the first electric connection portions 121 and the second electric connection portions 122 or common connection point members 130 may be used for the first electric connection portions 121 and the second electric connection portions 122. In this example, the first electric connection portions 121 and the second electric connection portions 122 use the common connection point members 130.

The connection point members 130 are made of a conductive material such as metal (copper, copper alloy, aluminum, aluminum alloy, or the like) and are shaped to have spring properties. In this example, the connection point members 130 are shaped by press processing such as cutting and folding using a conductive metal plate as a base material.

The connection point members 130 are mounted on the first electric connection portions 121 and the second electric connection portions 122 to be thereby physically and electrically connected to the first electric connection portions 121 and the second electric connection portions 122. That is to say, the counterpart terminals 110 include a combination of one pair of the first electric connection portions 121 and one connection point members 130 in a contact state and a combination of one pair of the second electric connection portions 122 and the other connection point members 130 in a contact state. With this configuration, the connection point members 130 can make contact with the first wall surfaces 11*a* and the second wall surfaces 11*b* of the electric connection portions 11 inserted in between the first electric connection portions 121 and the second electric connection portions 122. Accordingly, the connection point members 130 can electrically connect the electric connection portions 11 to the first electric connection portions 121 and the second electric connection portions 122.

Figure 15:
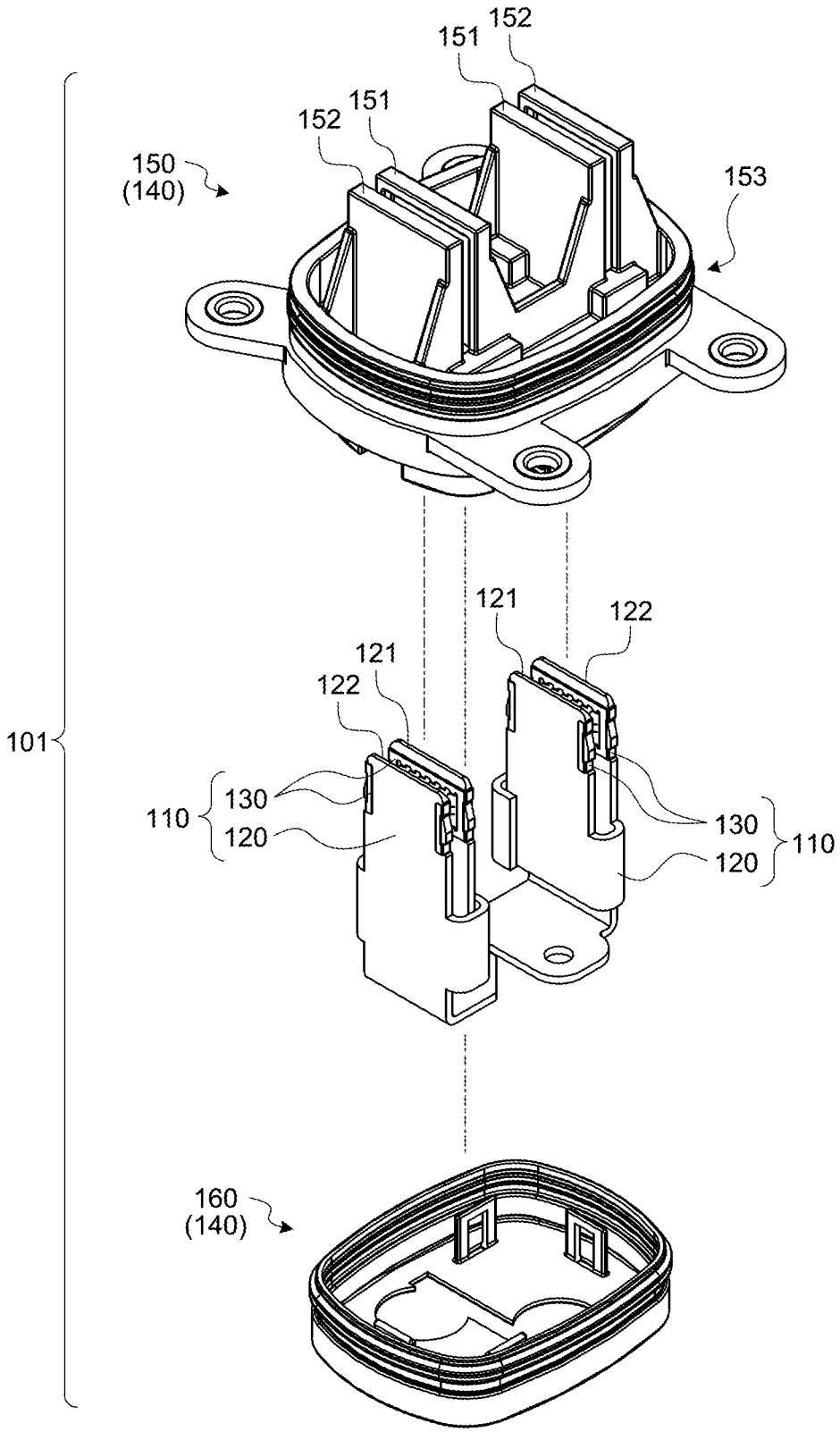
FIG. 15 is an exploded perspective view of the counterpart connector.

The counterpart connector 101 includes the housing 140 accommodating therein the counterpart terminals 110 (FIGS. 1 and 15). The housing 140 includes an accommodation member 150 (FIGS. 1 and 15) accommodating therein the counterpart terminals 110 and a holding member 160 (FIG. 15) preventing the accommodated counterpart terminals 110 from being extracted from the accommodation member 150.

The accommodation member 150 is made of an insulating material such as synthetic resin. The accommodation member 150 has first accommodation bodies 151 accommodating therein the combination of the pair of the first electric connection portions 121 and the one connection point members 130 and second accommodation bodies 152 accommodating therein the combination of the pair of the second electric connection portions 122 and the other connection point members 130 (FIGS. 1 and 15). The first accommodation bodies 151 are formed so as to surround the first electric connection portions 121 and the one connection point members 130 in a state in which the one connection point members 130 at the sides of the other connection point members 130 are exposed. The second accommodation bodies 152 are formed so as to surround the second electric connection portions 122 and the other connection point members 130 in a state in which the other connection point members 130 at the sides of the one connection point members 130 are exposed. The accommodation member 150 includes combinations of the first accommodation body 151 and the second accommodation body 152 for the respective counterpart terminals 110.

The accommodation member 150 has a cylindrical body 153 having both open ends in the cylindrical axis direction while the connector insertion/extraction direction is the cylindrical axis direction thereof (FIGS. 1 and 15). All of the combinations of the first accommodation body 151 and the second accommodation body 152 extend and project toward the connector insertion direction from an internal space of the cylindrical body 153. The cylindrical body 153 holds therein all of the combinations of the first accommodation body 151 and the second accommodation body 152.

Figure 16:
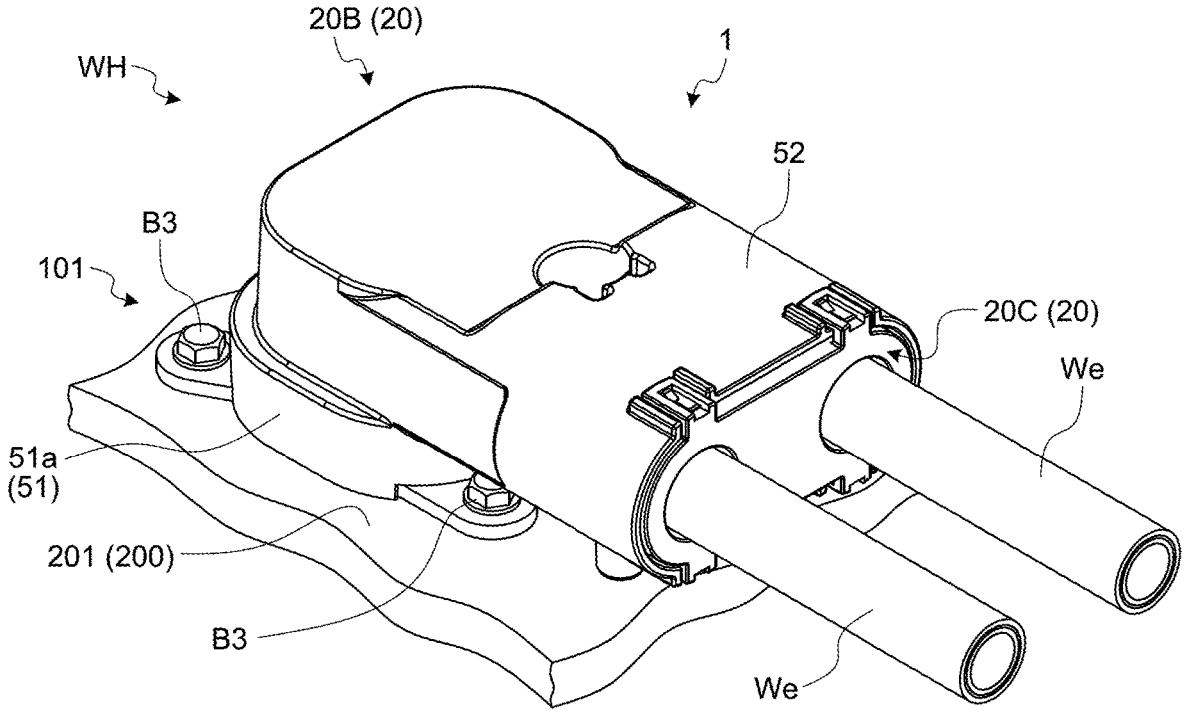
FIG. 16 is a perspective view illustrating the connector and the electric wire with the connector in the embodiment together with the counterpart connector after connector fitting.

The accommodation member 150 is fixed to the housing 201 of the power supply circuit 200 by screwing using external screw members B3 (FIGS. 1 and 16).

The holding member 160 is made of an insulating material such as synthetic resin and is shaped into a cylindrical form. The holding member 160 is fitted with the insertion holes of the counterpart terminals 110 in the cylindrical body 153.

The counterpart connector 101 employs this configuration.

The connector 1 is inserted and fitted into the counterpart connector 101 to be electrically connected to the counterpart connector 101, as described above (FIG. 16). The connector 1 in the embodiment is fixed to the housing 201 by screwing in order to keep a fitting state with the counterpart connector 101 (that is, electric connection state with the counterpart connector 101). In this example, the connector 1 is fixed to the housing 201 and the shield shell 20B and the braids We3 are electrically connected to the housing 201 by forming the through-holes 53 in the shield shell 20B (FIGS. 2, 3, 5, and 9) and by fixing and screwing the shield shell 20B to the housing 201 made of the conductive material such as metal by an external screw member B0 (FIG. 1). The housing 201 has an internal screw portion N0 with which the external screw member B0 is screwed and is grounded.

The connector and the electric wire with the connector according to the present embodiment do not require crimping processing unlike the conventional techniques because the first and the second holding members interpose the exposed braid (annular development portion) at the terminal of the electric wire only. The connector and the electric wire with the connector can therefore improve endurance of the electric wire because no unnecessary load acts on a core wire. Furthermore, the connector and the electric wire with the connector can be reduced in size along the axial line direction of the terminal of the electric wire because the braid is not folded back unlike the conventional technique. The connector and the electric wire with the connector do not require the conventional cylindrical member (that receives the force with the crimping of the cylindrical shield member). Furthermore, in the connector and the electric wire with the connector, the braid is grounded through the shield member by mounting the first and the second holding members on the shield member. That is to say, the connector and the electric wire with the connector can improve the endurance and the shield performance of the electric wire while being reduced in size.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a terminal fitting that has an electric connection portion configured to be electrically connected to a counterpart terminal of a counterpart connector and an electric wire connection portion configured to be electrically connected to a terminal of an electric wire;

an insulating accommodation body configured to accommodate the electric connection portion in an internal accommodation space and allow the electric wire connection portion to project outward together with the terminal of the electric wire;

a conductive shield member that has a main shield body covering the accommodation body externally and a sub shield body covering the electric wire connection portion and the terminal of the electric wire externally; and conductive first and second holding members configured to hold an exposed braid at the terminal of the electric wire between the first and the second holding members, wherein the sub shield body has a first accommodation chamber that covers the electric wire connection portion and an exposed core wire at the terminal of the electric wire externally and a second accommodation chamber that covers the exposed braid at the terminal of the electric wire and the first and the second holding members externally, and the first and the second holding members are members holding, between the first and the second holding members along an axial line of the terminal of the electric wire, an annular development portion of the braid that is formed by annularly developing the exposed braid to an outer side in a radial direction, have annular holding portions interposing the annular development portion therebetween, and are pressed against and fixed to the shield member along a holding direction of the annular development portion.

2. The connector according to claim 1, wherein the first holding member has a smooth surface portion that makes surface contact with a wall surface of the second accommodation chamber.

3. The connector according to claim 1, wherein the first holding member has a projecting portion that projects toward a wall surface of the second accommodation chamber and makes contact with the wall surface of the second accommodation chamber.

4. The connector according to claim 1, wherein the first and the second holding members are formed so as to be fastened together to the shield member by fixing by screwing with axial force along the holding direction of the annular development portion and have external screw insertion holes through which an external screw portion to be used for the fixing by screwing is inserted and facing wall surfaces that are arranged so as to face each other along the holding direction around the external screw insertion holes, and any one of the facing wall surface of the first holding member and the facing wall surface of the second holding member has a locking projecting portion that annularly projects concentrically with the external screw insertion holes toward the counterpart facing wall surface arranged so as to face the facing wall surface in the holding direction and locks an outer end portion of the annular development portion in the radial direction.

5. The connector according to claim 2, wherein the first and the second holding members are formed so as to be fastened together to the shield member by fixing by screwing with axial force along the holding direction of the annular development portion and have external screw insertion holes through which an external screw portion to be used for the fixing by screwing is inserted and facing wall surfaces that are arranged so as to face each other along the holding direction around the external screw insertion holes, and any one of the facing wall surface of the first holding member and the facing wall surface of the second holding member has a locking projecting portion that annularly projects concentrically with the external screw insertion holes toward the counterpart facing wall surface arranged so as to face the facing wall surface in the holding direction and locks an outer end portion of the annular development portion in the radial direction.

6. The connector according to claim 3, wherein the first and the second holding members are formed so as to be fastened together to the shield member by fixing by screwing with axial force along the holding direction of the annular development portion and have external screw insertion holes through which an external screw portion to be used for the fixing by screwing is inserted and facing wall surfaces that are arranged so as to face each other along the holding direction around the external screw insertion holes, and any one of the facing wall surface of the first holding member and the facing wall surface of the second holding member has a locking projecting portion that annularly projects concentrically with the external screw insertion holes toward the counterpart facing wall surface arranged so as to face the facing wall surface in the holding direction and locks an outer end portion of the annular development portion in the radial direction.

7. The connector according to claim 4, wherein the annular holding portion of the first holding member or the second holding member that has the locking projecting portion has an annular projecting portion projects annularly and concentrically toward the counterpart annular holding portion arranged so as to face the annular holding portion in the holding direction.

8. The connector according to claim 1, further comprising:

a plurality of combinations of the terminal fitting and the electric wire, wherein the first and the second holding members have the annular holding portions for the respective annular development portions of all of the electric wires, and the sub shield body has the first accommodation chambers for the respective combinations of the terminal fitting and the electric wire and the second accommodation chamber that accommodates the annular development portions of all of the electric wires together with the first and the second holding members.

9. The connector according to claim 2, further comprising:

a plurality of combinations of the terminal fitting and the electric wire, wherein the first and the second holding members have the annular holding portions for the respective annular development portions of all of the electric wires, and the sub shield body has the first accommodation chambers for the respective combinations of the terminal fitting and the electric wire and the second accommodation chamber that accommodates the annular development portions of all of the electric wires together with the first and the second holding members.

10. The connector according to claim 3, further comprising:

a plurality of combinations of the terminal fitting and the electric wire, wherein the first and the second holding members have the annular holding portions for the respective annular development portions of all of the electric wires, and the sub shield body has the first accommodation chambers for the respective combinations of the terminal fitting and the electric wire and the second accommodation chamber that accommodates the annular development portions of all of the electric wires together with the first and the second holding members.

11. The connector according to claim 4, further comprising:

a plurality of combinations of the terminal fitting and the electric wire, wherein the first and the second holding members have the annular holding portions for the respective annular development portions of all of the electric wires, and the sub shield body has the first accommodation chambers for the respective combinations of the terminal fitting and the electric wire and the second accommodation chamber that accommodates the annular development portions of all of the electric wires together with the first and the second holding members.

12. The connector according to claim 7, further comprising:

a plurality of combinations of the terminal fitting and the electric wire, wherein the first and the second holding members have the annular holding portions for the respective annular development portions of all of the electric wires, and the sub shield body has the first accommodation chambers for the respective combinations of the terminal fitting and the electric wire and the second accommodation chamber that accommodates the annular development portions of all of the electric wires together with the first and the second holding members.

13. An electric wire with a connector, comprising:

an electric wire;

a terminal fitting that has an electric connection portion configured to be electrically connected to a counterpart terminal of a counterpart connector and an electric wire connection portion configured to be electrically connected to a terminal of the electric wire;

an insulating accommodation body configured to accommodate the electric connection portion in an internal accommodation space and allow the electric wire connection portion to project outward together with the terminal of the electric wire;

a conductive shield member that has a main shield body covering the accommodation body externally and a sub shield body covering the electric wire connection portion and the terminal of the electric wire externally; and conductive first and second holding members configured to hold an exposed braid at the terminal of the electric wire between the first and the second holding members, wherein the sub shield body has a first accommodation chamber that covers the electric wire connection portion and an exposed core wire at the terminal of the electric wire externally and a second accommodation chamber that covers the exposed braid at the terminal of the electric wire and the first and the second holding members externally, and the first and the second holding members are members holding, between the first and the second holding members along an axial line of the terminal of the electric wire, an annular development portion of the braid that is formed by annularly developing the exposed braid to an outer side in a radial direction, have annular holding portions interposing the annular development portion therebetween, and are pressed against and fixed to the shield member along a holding direction of the annular development portion.

* * * * *